US011193464B2

(12) United States Patent
Tanada et al.

(10) Patent No.: US 11,193,464 B2
(45) Date of Patent: Dec. 7, 2021

(54) FUEL INJECTION VALVE

(71) Applicant: DENSO CORPORATION, Kariya (JP)

(72) Inventors: Hiroki Tanada, Kariya (JP); Naofumi Adachi, Kariya (JP); Masayuki Suzuki, Kariya (JP); Toshiaki Hijima, Nisshin (JP); Motoya Kambara, Nisshin (JP)

(73) Assignee: DENSO CORPORATION, Kariya (JP)

( * ) Notice: Subject to any disclaimer, the term of this patent is extended or adjusted under 35 U.S.C. 154(b) by 122 days.

(21) Appl. No.: 16/795,946

(22) Filed: Feb. 20, 2020

(65) Prior Publication Data

US 2020/0191104 A1 Jun. 18, 2020

Related U.S. Application Data

(63) Continuation of application No. PCT/JP2018/030875, filed on Aug. 21, 2018.

(30) Foreign Application Priority Data

Aug. 24, 2017 (JP) ..... JP2017-161662
Jul. 18, 2018 (JP) ..... JP2018-134992

(51) Int. Cl.
*F02M 1/00* (2006.01)
*F02M 47/02* (2006.01)
*F02M 63/00* (2006.01)

(52) U.S. Cl.
CPC ..... *F02M 47/027* (2013.01); *F02M 63/0029* (2013.01); *F02M 63/0033* (2013.01)

(58) Field of Classification Search
CPC ..... F02D 41/3809; F02M 55/025; F02M 63/0275; F02M 69/465; Y10S 239/90
USPC ..... 123/445, 446, 456; 239/533.3, 585.1, 239/585.2, 584
See application file for complete search history.

(56) References Cited

U.S. PATENT DOCUMENTS 4,579,096 A * 4/1986 Kobayashi ..... F02D 41/402 123/299
4,805,580 A * 2/1989 Buisson ..... F02M 55/04 123/506
5,441,028 A * 8/1995 Felhofer ..... F02M 51/00 123/456

(Continued)

FOREIGN PATENT DOCUMENTS

DE 10-2013-112751 5/2015
JP 2000-297719 10/2000

OTHER PUBLICATIONS

International Search Report for PCT/JP2018/00875, dated Nov. 20, 2018, 4 pages.

*Primary Examiner* — John Kwon
(74) *Attorney, Agent, or Firm* — Nixon & Vanderhye P.C.

(57) ABSTRACT

A fuel injection valve includes a needle valve that controls communication between a high pressure chamber and an injection hole, a follower valve provided inside a control chamber controlled by fuel pressure inside an intermediate chamber, and an open-close valve that controls communication between a first passage and a low pressure passage and communication between a second passage and the low pressure passage. The fuel injection valve is configured to control the gradient of the fuel injection rate from the injection hole with an improved configuration.

14 Claims, 21 Drawing Sheets

(56) References Cited

U.S. PATENT DOCUMENTS

| | | | | |
|---|---|---|---|---|
| 5,477,834 | A * | 12/1995 | Yoshizu | F02D 41/403 123/501 |
| 2003/0038258 | A1* | 2/2003 | Stoecklein | F15B 3/00 251/57 |
| 2005/0211804 | A1* | 9/2005 | Omae | F02M 61/205 239/585.1 |
| 2015/0167609 | A1 | 6/2015 | Harcombe et al. | |
| 2016/0356251 | A1* | 12/2016 | Kanbara | F02M 45/10 |
| 2018/0045153 | A1 | 2/2018 | Harcombe et al. | |

* cited by examiner

COMPARATIVE EXAMPLE

COMPARATIVE EXAMPLE

COMPARATIVE EXAMPLE

COMPARATIVE EXAMPLE

FUEL INJECTION VALVE

CROSS REFERENCE TO RELATED APPLICATION

The present application is a continuation application of International Patent Application No. PCT/JP2018/030875 filed on Aug. 21, 2018, which designated the U.S. and claims the benefit of priority from, Japanese Patent Application No. 2017-161662 filed on Aug. 24, 2017 and Japanese Patent Application No. 2018-134992 filed on Jul. 18, 2018. The entire disclosures of all of the above applications are incorporated herein by reference.

TECHNICAL FIELD

The present disclosure relates to a fuel injection valve capable of controlling the gradient of a fuel injection rate.

BACKGROUND

Typically, in this type of fuel injection valves, a control chamber is provided for generating fuel pressure for controlling the lift of a needle valve. An open-close valve may be provided to control, among other things, the fuel pressure in the control chamber. This type of fuel injection valves is subject to improvement in design.

SUMMARY

In one aspect of the present disclosure, a fuel injection valve capable of controlling a gradient of a fuel injection rate has a main body including a high pressure chamber supplied with high pressure fuel, an injection hole configured to inject the fuel from the high pressure chamber, a high pressure passage supplied with the high pressure fuel, a control chamber connected to the high pressure passage, a low pressure passage that discharges low pressure fuel, a first passage connected to the low pressure passage, an intermediate chamber that connects the control chamber to the first passage, and a second passage that connects the control chamber to the low pressure passage, a needle valve configured to, based on a fuel pressure in the control chamber, allow or block communication between the high pressure chamber and the injection hole, a follower valve provided inside the control chamber, a lift amount of the follower valve being controlled based on a fuel pressure inside the intermediate chamber, and an open-close valve configured to allow or block communication between the first passage and the low pressure passage, and allow or block communication between the second passage and the low pressure passage.

The follower valve is provided with a third passage that extends through the follower valve, a first throttle that restricts fuel flow rate being provided in the third passage, the follower valve is configured to block communication between the high pressure passage and the control chamber when the control chamber is in communication with the intermediate chamber through the third passage, and allow communication between the high pressure passage and the control chamber when the control chamber is in communication with the intermediate chamber without passing through the third passage, and the second passage is in communication with the control chamber without passing through the follow valve, a second throttle that restricts fuel flow rate being provided in the second passage.

BRIEF DESCRIPTION OF DRAWINGS

The above and other objects, features and advantages of the present disclosure will become more apparent from the following detailed description made with reference to the accompanying drawings. In the drawings.

DETAILED DESCRIPTION

First Embodiment

Hereinafter, a first embodiment implemented as a fuel injection system applied to an engine (internal combustion engine) of an automobile (vehicle) will be described with reference to the drawings. The engine can use a liquid fuel such as diesel fuel, gasoline, or an ethanol mixture as fuel. In the present embodiment, a diesel engine will be described as an example.

Figure 1:
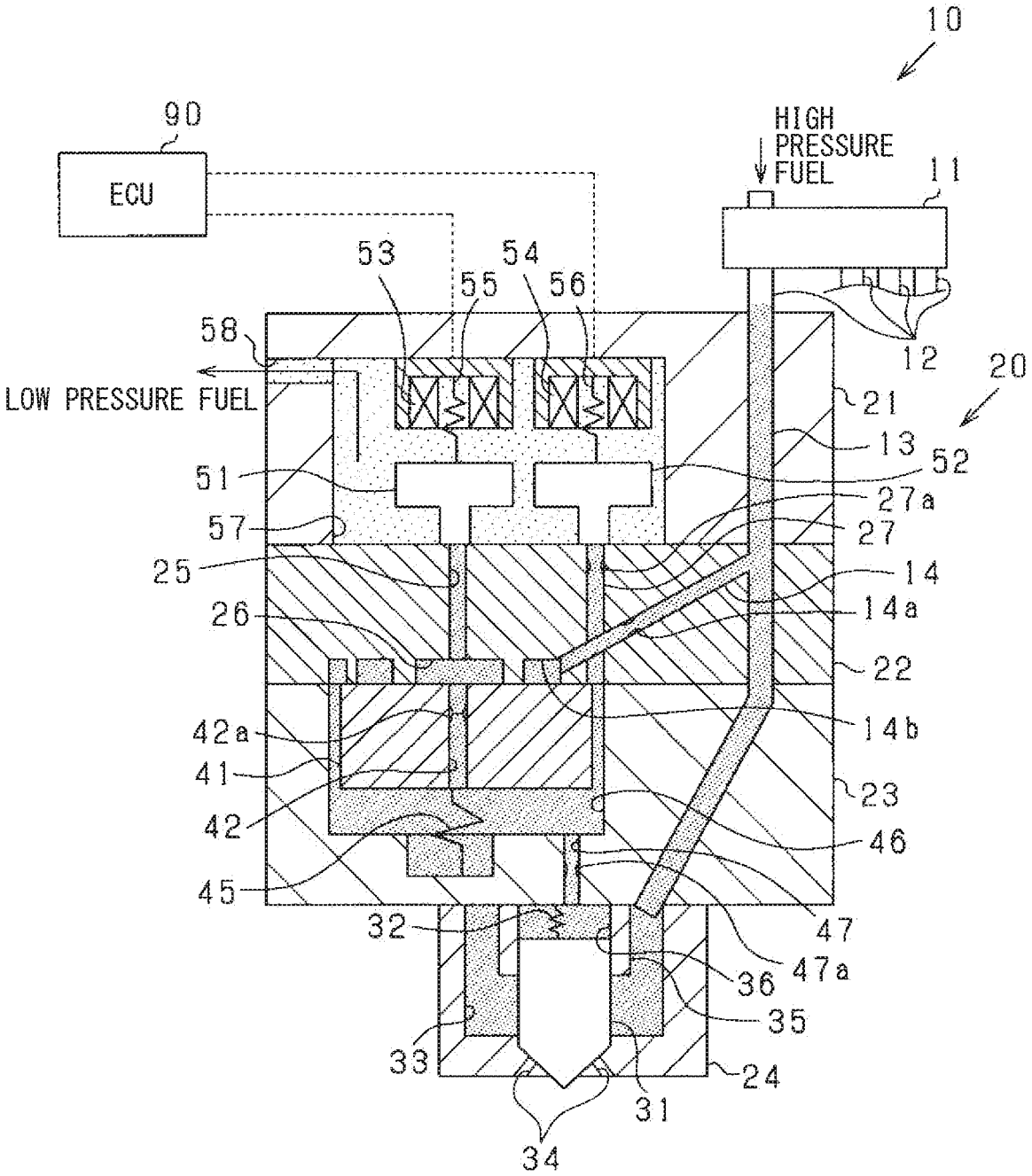
FIG. 1 is a schematic view showing a fuel injection system according to a first embodiment.

As shown in FIG. 1, a fuel injection system 10 includes a common rail 11, high pressure pipes 12, a fuel injection valve 20, and an ECU 90.

The common rail 11 (corresponding to a retention container) is supplied with high pressure fuel from a high pressure pump (not shown). The common rail 11 retains high pressure fuel inside in a high pressure state. Each fuel injection valve 20 (only one is shown in FIG. 1) is connected to the common rail 11 via a respective high pressure pipe 12. Note that the common rail 11 is not provided with a pressure reducing valve for reducing the fuel pressure inside the common rail 11.

The fuel injection valve 20 includes first to fourth members 21 to 24, a needle valve 31, a spring 32, a follower valve 41, a spring 45, a first open-close valve 51, a second open-close valve 52, a first solenoid 53, a second solenoid 54, a first spring 55, and a second spring 56. The main body of the fuel injection valve 20 is formed by the first to fourth members 21 to 24.

The first member 21 has a first high pressure passage 13, a low pressure chamber 57, and a low pressure passage 58 formed therein. The first high pressure passage 13 is formed across the first to third members 21 to 23 and extends through the first to third members 21 to 23. The first high pressure passage 13 is connected to the high pressure pipe 12. That is, high pressure fuel is supplied from the high pressure pipe 12 to the first high pressure passage 13. The surface of the low pressure chamber 57 facing the second member 22 has an opening. The periphery of the opening is sealed between the first member 21 and the second member 22. A low pressure passage 58 is connected to the low pressure chamber 57. A low pressure pipe (not shown) is connected to the low pressure passage 58. The low pressure fuel in the low pressure chamber 57 is discharged to the outside of the fuel injection valve 20 through the low pressure passage 58.

The second member 22 has a second high pressure passage 14, a first passage 25, an intermediate chamber 26, and a second passage 27 formed therein. The second high pressure passage 14 (corresponding to a "high pressure passage") branches off from the first high pressure passage 13. That is, high pressure fuel is supplied from the first high pressure passage 13 to the second high pressure passage 14. The second high pressure passage 14 has a third throttle 14*a* and an annular chamber 14*b*. The third throttle 14*a* limits the flow rate of the fuel flowing through the second high pressure passage 14. The annular chamber 14*b* is a chamber formed in an annular shape, and opens on the side facing the third member 23. That is, the second high pressure passage 14 is connected to a first control chamber 46 described later via the annular chamber 14*b*. In addition, the second high pressure passage 14 may include a plurality of third throttles 14*a*, or the passage cross sectional area of the second high pressure passage 14 may be set to be small so that the second high pressure passage 14 itself functions as the third throttle 14*a*.

One end of the first passage 25 is connected to the low pressure chamber 57, and the other end of the first passage 25 is connected to the intermediate chamber 26. The intermediate chamber 26 is connected to the low pressure passage 58 via the first passage 25 and the low pressure chamber 57. The intermediate chamber 26 is a cylindrical-shaped chamber, and is open on the side facing the third member 23. That is, the intermediate chamber 26 connects the first passage 25 to the first control chamber 46 described later. One end of the second passage 27 is connected to the low pressure chamber 57, and the other end of the second passage 27 is connected to the first control chamber 46. That is, the second passage 27 connects the low pressure chamber 57 to the first control chamber 46. The second passage 27 has a second throttle 27*a*. The second throttle 27*a* is provided near the end of the second passage 27 toward the low pressure chamber 57 (the second open-close valve 52). The second throttle 27*a* limits the flow rate of the fuel flowing through the second passage 27. In addition, the second passage 27 may include a plurality of second throttles 27*a*, or the passage cross sectional area of the second passage 27 may be set to be small so that the second passage 27 itself functions as the second throttle 27*a*.

The first control chamber 46 and a connection passage 47 are formed in the third member 23. The first control chamber 46 includes an opening on the side facing the second member 22. The periphery of the opening is sealed between the second member 22 and the third member 23. The connection passage 47 is connected to the first control chamber 46. The connection passage 47 is further connected to a second control chamber 36 described later. That is, the connection passage 47 (corresponding to a "fourth passage") connects the first control chamber 46 to the second control chamber 36. The connection passage 47 has a fourth throttle 47*a*. The fourth throttle 47*a* limits the flow rate of the fuel flowing through the connection passage 47. In addition, the connection passage 47 may include a plurality of fourth throttles 47*a*, or the passage cross sectional area of the connection passage 47 may be set to be small so that the connection passage 47 itself functions as the fourth throttle 47*a*.

In the fourth member 24, a high pressure chamber 33, an injection hole 34, a cylinder 35, and the second control chamber 36 are formed. The high pressure chamber 33 is connected to the first high pressure passage 13, the second control chamber 36, and the injection hole 34. That is, high pressure fuel is supplied from the first high pressure passage 13 to the high pressure chamber 33. The injection hole 34 is in communication with outside of the fourth member 24. A needle valve 31 is disposed inside the fourth member 24. The tip of the needle valve 31 is formed in a conical shape, and the remaining portion of the needle valve 31 (i.e., excluding the tip) is formed in a cylindrical shape. The cylinder 35 supports the needle valve 31 while allowing the needle valve 31 to freely reciprocate. A spring 32 that biases the needle valve 31 in a direction of approaching the injection hole 34 is disposed inside the second control chamber 36. The end face of the needle valve 31 opposite to the injection hole 34 is exposed inside the second control chamber 36. The first control chamber 46 and the second control chamber 36 are collectively referred to as a control chamber.

When the fuel pressure inside the second control chamber 36 is higher than a predetermined pressure, the needle valve 31 is either maintained in a state of blocking communication between the high pressure chamber 33 and the injection hole 34, or the needle valve 31 is moved in the direction toward the injection hole 34. When the fuel pressure inside the second control chamber 36 is lower than the predetermined pressure, the needle valve 31 is moved toward the third member 23 or maintained in a state of allowing communication between the high pressure chamber 33 and the injection hole 34. As a result, the high pressure fuel inside the high pressure chamber 33 is injected from the injection holes 34. That is, the needle valve 31 selectively allows or blocks communication between the high pressure chamber 33 and the injection hole 34 based on the fuel pressure inside the second control chamber 36.

In the third member 23, a follower valve 41 is disposed inside the first control chamber 46. The follower valve 41 is formed in a cylindrical shape. The follower valve 41 is formed with a third passage 42 that extends through the follower valve 41 in the central axis direction. The third passage 42 has a first throttle 42*a*. The first throttle 42*a* limits the flow rate of the fuel flowing through the third passage 42. In addition, the third passage 42 may include a plurality of first throttles 42*a*, or the passage cross sectional area of the third passage 42 may be set to be small so that the third passage 42 itself functions as the first throttle 42*a*.

Inside the first control chamber 46, a spring 45 for biasing the follower valve 41 in a direction of approaching the intermediate chamber 26 (the second member 22) is arranged. When the follower valve 41 abuts the second member 22, the intermediate chamber 26 is in communication with the first control chamber 46 via the third passage 42, and the opening of the annular chamber 14*b* facing the third member 23 is closed by the follower valve 41. When the follower valve 41 is separated from the second member 22, the intermediate chamber 26 is in communication with the first control chamber 46 without passing through the third passage 42, and the annular chamber 14*b* is in communication with the first control chamber 46. Further, the second passage 27 is in communication with the first control chamber 46 without passing through the follower valve 41. That is, the second passage 27 directly connects the low pressure chamber 57 and to the control chamber 46 regardless of the position (lift state) of the follower valve 41.

In the first member 21, a first open-close valve 51, a second open-close valve 52, a first solenoid 53, a second solenoid 54, a first spring 55, and a second spring 56 are disposed inside the low pressure chamber 57. The first spring 55 biases the first open-close valve 51 (corresponding to an "open-close valve") in a direction of approaching the first passage 25. When the first open-close valve 51 abuts the second member 22, the first open-close valve 51 blocks off the first passage 25 from the low pressure chamber 57 (and thus also from the low pressure passage 58). The first open-close valve 51 does not have a portion that slides within the first passage 25 (the second member 22). Instead, the first open-close valve 51 simply opens and closes the open end of the first passage 25. When the first open-close valve 51 blocks off the first passage 25 from the low pressure chamber 57, no fuel leaks between the first passage 25 and the low pressure chamber 57. That is, the first open-close valve 51 has a leakless structure. The second spring 56 biases the second open-close valve 52 (corresponding to an "open-close valve") in a direction of approaching the second passage 27. When the second open-close valve 52 abuts the second member 22, the second open-close valve 52 blocks off the second passage 27 from the low pressure chamber 57 (and thus also from the low pressure passage 58). The second open-close valve 52 does not have a portion that slides within the second passage 27 (the second member 22). Instead, the second open-close valve 52 simply opens and closes the open end of the second passage 27. When the second open-close valve 52 blocks off the second passage 27 and the low pressure chamber 57, no fuel leaks between the second passage 27 and the low pressure chamber 57. That is, the second open-close valve 52 has a leakless structure. When the first open-close valve 51 and the second open-close valve 52 are closed, the fuel pressure inside each of the second control chamber 36, the first control chamber 46, the intermediate chamber 26, the first passage 25, and the second passage 27 is at a balanced high pressure. The follower valve 41 is biased by the spring 45 to abut the second member 22.

When the first solenoid 53 is energized, the first solenoid 53 separates the first open-close valve 51 from the second member 22 (the opening end of the first passage 25) against the biasing force of the first spring 55. As a result, the first open-close valve 51 allows the first passage 25 to communicate with the low pressure chamber 57. When the first passage 25 and the low pressure chamber 57 are in communication with each other, the fuel inside the intermediate chamber 26 is discharged to the outside of the fuel injection valve 20 through the first passage 25, the low pressure chamber 57, and the low pressure passage 58. When the second solenoid 54 is energized, the second solenoid 54 separates the second open-close valve 52 from the second member 22 (the opening end of the second passage 27) against the biasing force of the second spring 56. Thus, the second open-close valve 52 allows the second passage 27 to communicate with the low pressure chamber 57. When the second passage 27 is in communication with the low pressure chamber 57, the fuel inside the first control chamber 46 is discharged to the outside of the fuel injection valve 20 via the second passage 27, the low pressure chamber 57, and the low pressure passage 58.

In a state where the first passage 25 is in communication with the low pressure chamber 57 (i.e., the first open-close valve 51 is open) and the second passage 27 is in communication with the low pressure chamber 57 (i.e., the second open-close valve 52 is open), the fuel pressure inside the first control chamber 46 decreases at a faster rate as compared to a state where the first passage 25 is in communication with the low pressure chamber 57 while the second passage 27 is blocked from the low pressure chamber 57 (i.e., the second open-close valve 52 is closed). For this reason, the lift speed (rise speed) of the needle valve 31 in a state where the first open-close valve 51 is open and the second open-close valve 52 is open is greater as compared to the lift speed (rise speed) of the needle valve 31 in a state in which the first open-close valve 51 is open and the second open-close valve 52 is closed. Therefore, the rate of increase (gradient) of the injection rate when the first open-close valve 51 is open and the second open-close valve 52 is open is greater than the rate of increase (gradient) of the injection rate when the first open-close valve 51 is open and the second open-close valve 52 is closed.

Thereafter, when the energization drive of the first solenoid 53 is stopped, the first open-close valve 51 abuts the second member 22 due to the biasing force of the first spring 55. As a result, the first passage 25 and the low pressure chamber 57 are closed off by the first open-close valve 51. When the fuel pressure inside the intermediate chamber 26 rises and the force with which the follower valve 41 is attracted to the intermediate chamber 26 decreases, the pressure of the high pressure fuel inside the second high pressure passage 14 causes the follower valve 41 to move away from the second member 22. As a result, the first control chamber 46 and the intermediate chamber 26 are in communication with each other without passing through the third passage 42 of the follower valve 41, and the second high pressure passage 14 is in communication with the first control chamber 46. Then, the fuel pressure inside the first control chamber 46 increases, and fuel flows from the first control chamber 46 into the second control chamber 36 via the connection passage 47. As a result, the needle valve 31 starts to descend (moves in the direction toward the injection hole 34), and the needle valve 31 shifts to a valve closing operation.

Here, when the first open-close valve 51 is closed and the second open-close valve 52 is closed, the pressure inside the first control chamber 46 increases faster than when the first open-close valve 51 is closed and the second open-close valve 52 is open. For this reason, the fall speed of the needle valve 31 in a state where the first open-close valve 51 is closed and the second open-close valve 52 is closed is greater as compared to the fall speed of the needle valve 31 in a state in which the first open-close valve 51 is closed and the second open-close valve 52 is open. Therefore, the rate of decrease (gradient) of the injection rate when the first open-close valve 51 is closed and the second open-close valve 52 is closed is greater than the rate of decrease (gradient) of the injection rate when the first open-close valve 51 is closed and the second open-close valve 52 is open.

The ECU (Electronic Control Unit) 90 is a microcontroller including a CPU, a ROM, a RAM, a drive circuit, an input/output interface, etc. The ECU 90 (corresponding to a "drive unit") electrically drives the first solenoid 53 and the second solenoid 54 independently of each other. That is, the ECU 90 can independently control the first open-close valve 51 to allow or block communication between the first passage 25 and the low pressure chamber 57 and independently control the second open-close valve 52 to allow or block communication between the second passage 27 and the low pressure chamber 57.

Figure 2:
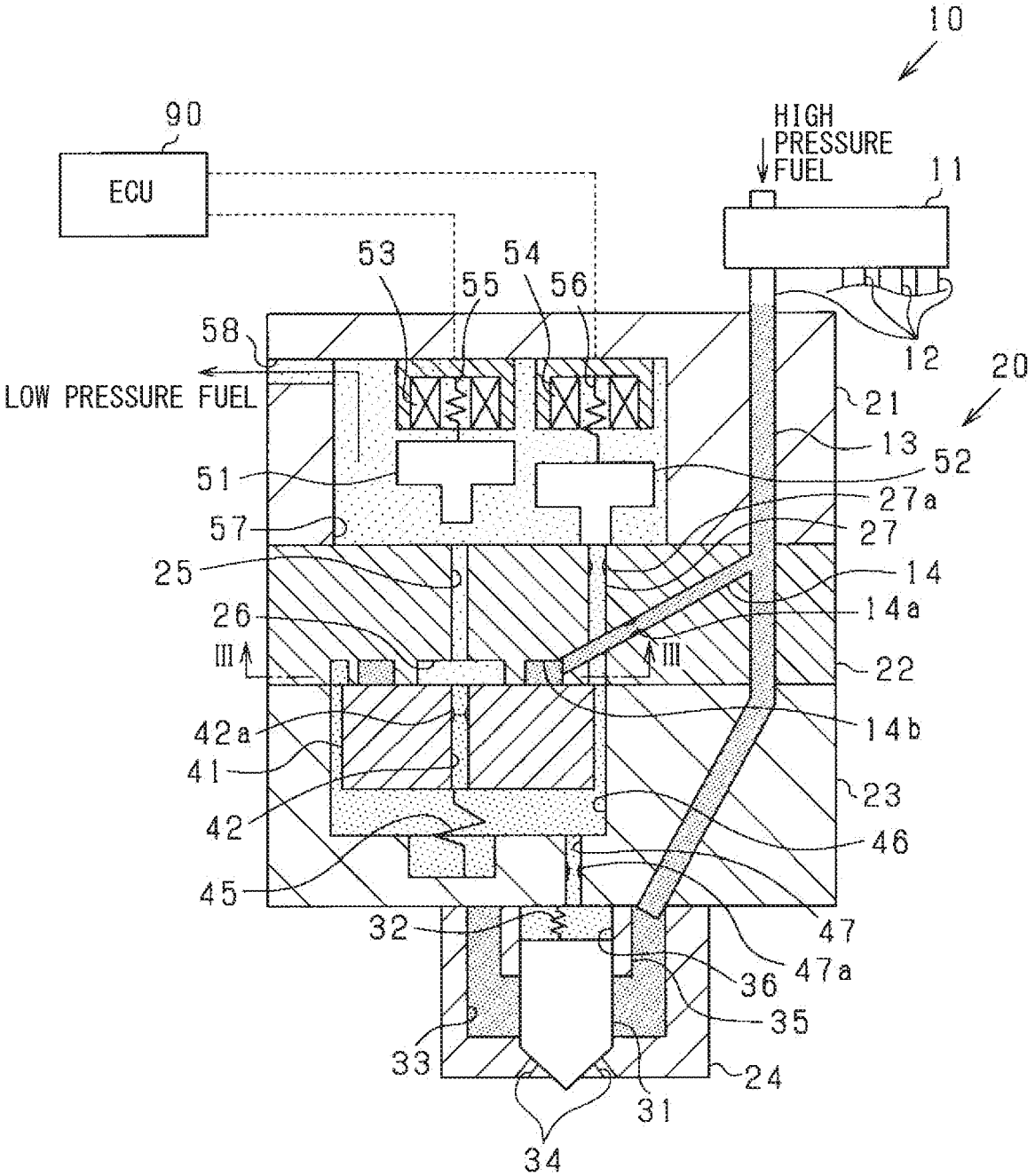
FIG. 2 is a schematic view showing a state where a first open-close valve is opened.

When the first open-close valve 51 and the second open-close valve 52 are both in a closed state and the first open-close valve 51 is opened, as shown in FIG. 2, the fuel in the intermediate chamber 26 is discharged to outside of the fuel injection valve 20 through the low pressure chamber 57 and the low pressure passage 58. Here, the intermediate chamber 26 is connected to the first control chamber 46 via the third passage 42. Since the third passage 42 has the first throttle 42*a*, a pressure difference is generated in the fuel before and after the first throttle 42*a*. Therefore, the fuel pressure inside the intermediate chamber 26 becomes a low pressure, while the fuel pressure inside the first control chamber 46 becomes a medium pressure. As a result, the follower valve 41 is attracted to the intermediate chamber 26, and the annular chamber 14*b* (that is, the second high pressure passage 14) and the first control chamber 46 are blocked off by the follower valve 41.

In other words, the passage cross sectional area of the first throttle 42*a*, the opening area of the intermediate chamber 26 facing the third member 23 (i.e., facing the first control chamber 46), the opening area of the annular chamber 14*b* facing the third member 23 (i.e., facing the first control chamber), and the biasing force of the spring 45 are set such that when the first passage 25 is in communication with the low pressure chamber 57 through the first open-close valve 51, the annular chamber 14*b* and the first control chamber 46 are blocked off from each other by the follower valve 41. That is, when the first passage 25 is in communication with the low pressure chamber 57 through the first open-close valve 51, the first control chamber 46 and the intermediate chamber 26 are in communication with each other via the third passage 42 through the follower valve 41, and this is achieved by appropriately setting the fuel flow rate limit of the first throttle 42*a*, the exposed area of the intermediate chamber 26 to the follower valve 41, the exposed area of the first high pressure passage 13 to the follower valve 41, and the biasing force of the spring.

Figure 3:
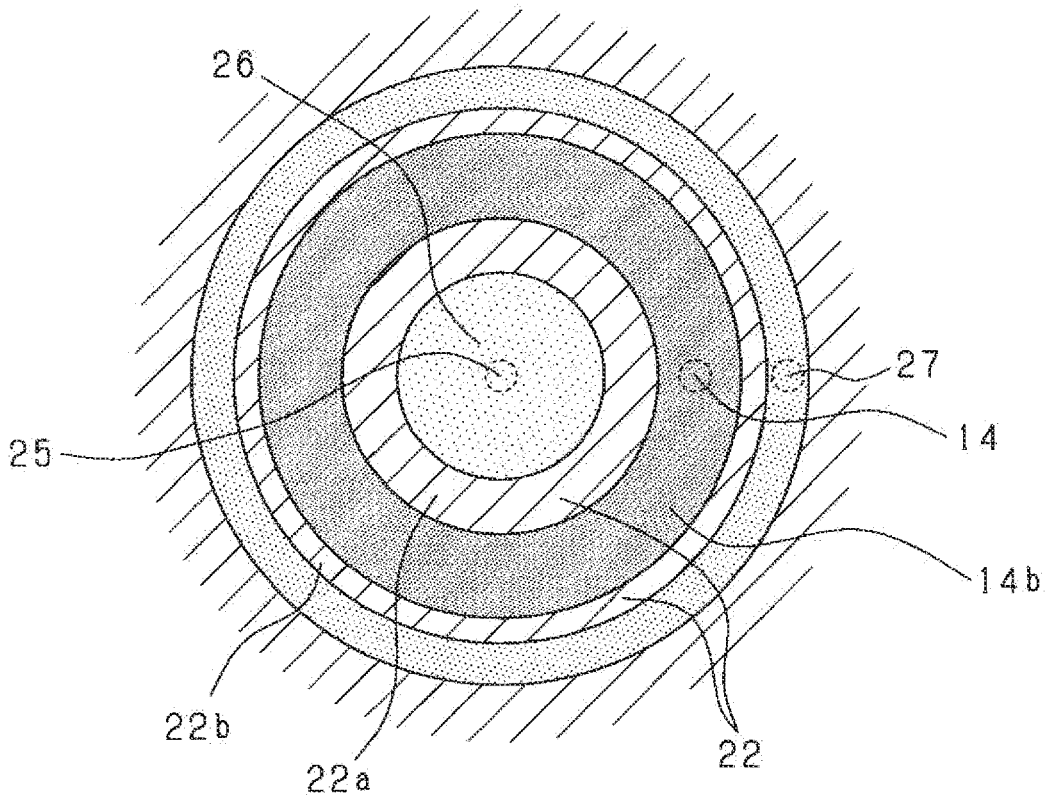
FIG. 3 is a cross sectional view taken along line III-III of FIG. 2.

FIG. 3 is a cross sectional view taken along line III-III of FIG. 2. As shown in the figure, in a state where the follower valve 41 blocks off communication between the annular chamber 14*b* and the first control chamber 46, the follower valve 41 seals each of the intermediate chamber 26 and the annular chamber 14*b* in regions 22*a* and 22*b*.

Figure 4:
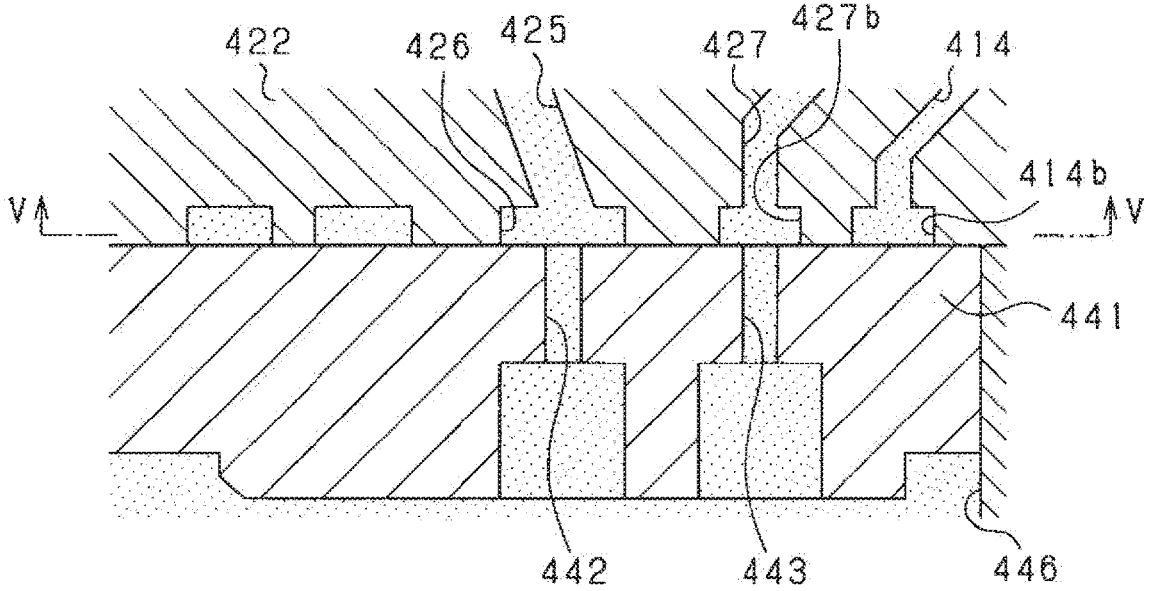
FIG. 4 is a partial enlarged view showing the vicinity of a follower valve according to a comparative example.

FIG. 4 is a partial enlarged view showing the vicinity of a follower valve 441 according to a comparative example. In the figure, portions corresponding to respective portions in FIG. 1 are denoted by reference numerals obtained by adding 400 to the reference numerals of the respective portions in FIG. 1. In this comparative example, between the first passage 425 and the second high pressure passage 414, the annular chamber 427*b* of the second passage 427 is in communication with the control chamber 446 via the fourth passage 443 formed in the follower valve 441. That is, in this comparative example, when the follower valve 441 blocks the second high pressure passage 414 from the control chamber 446, the first passage 425 and the second passage 427 are connected to the third passage 442 and the fourth passage 443 formed in the follower valve 441 to be in communication with the control chamber 446.

Figure 5:
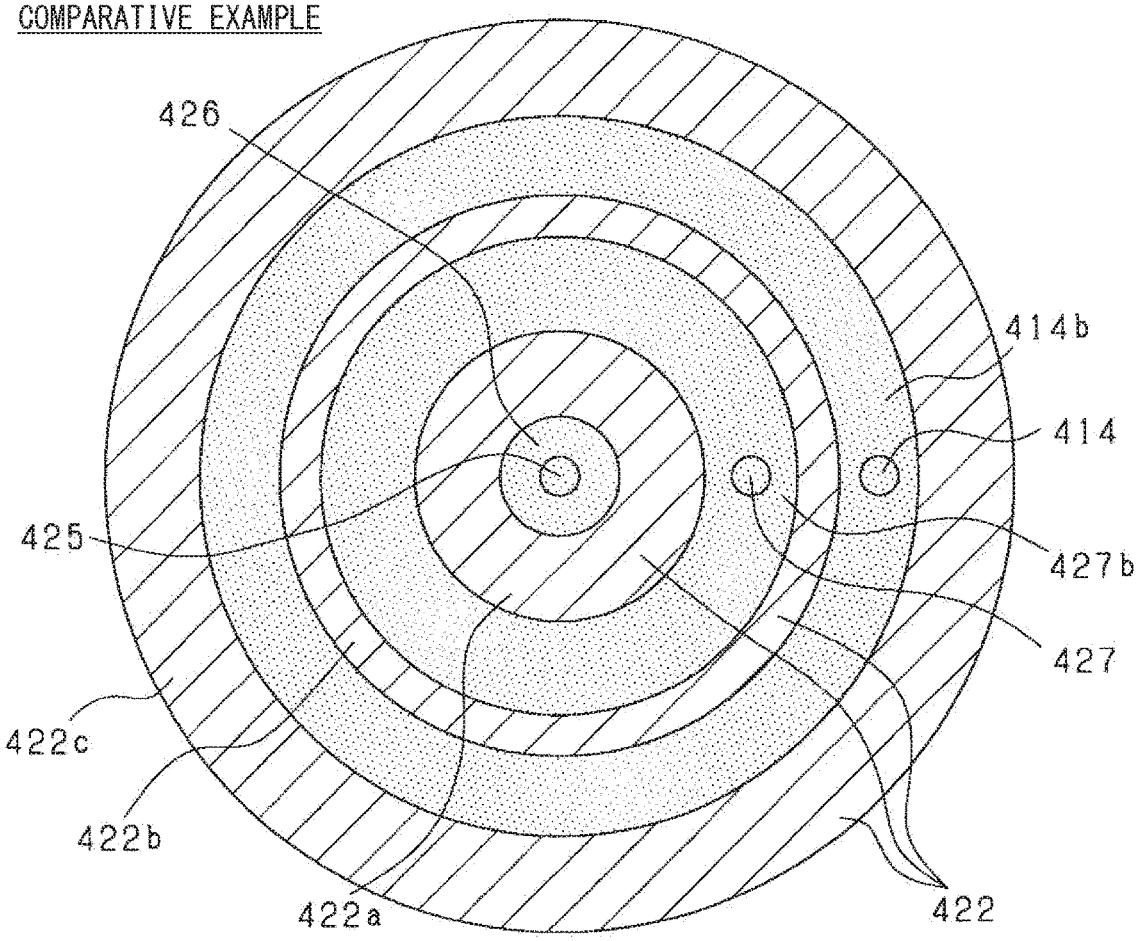
FIG. 5 is a cross sectional view taken along line V-V of FIG. 4.

FIG. 5 is a cross sectional view taken along line V-V of FIG. 4. As shown in the figure, in a state where the follower valve 441 blocks off communication between the annular chamber 414*b* and the control chamber 446, the follower valve 441 seals each of the intermediate chamber 426, the annular chamber 414*b*, and the annular chamber 427*b* in areas 422*a*, 422*b*, and 422*c*.

That is, the comparative example requires the regions 422*a*, 422*b*, and 422*c* as the seal regions in the follower valve 441. In contrast, the present embodiment only requires the regions 22*a* and 22*b* as the seal regions in the follower valve 41. Therefore, in the present embodiment, the number of seal areas required in the follower valve 41 can be reduced, and the configuration near the follower valve 41 can be simplified.

Figure 6:
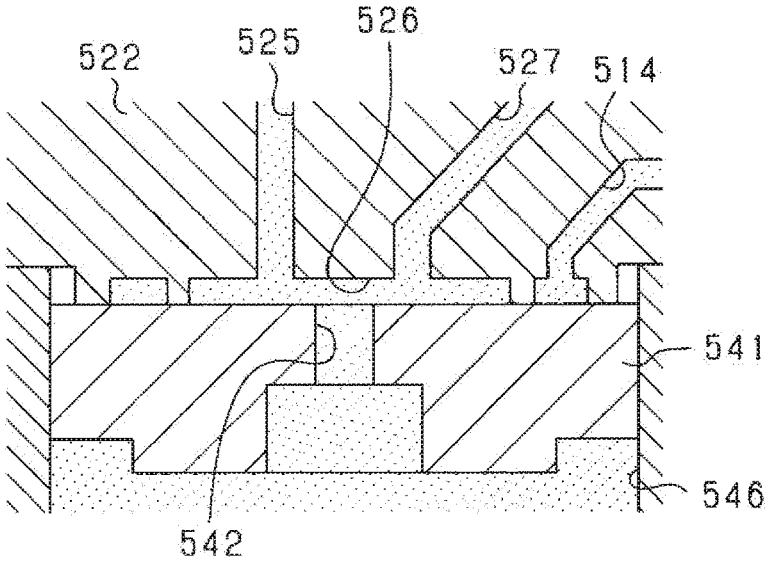
FIG. 6 is a partial enlarged view showing the vicinity of a follower valve according to another comparative example.

FIG. 6 is a partial enlarged view showing the vicinity of a follower valve 541 according to another comparative example. In the figure, portions corresponding to respective portions in FIG. 1 are denoted by reference numerals obtained by adding 500 to the reference numerals of the respective portions in FIG. 1. In this comparative example, the first passage 525 and the second passage 527 are in communication with the intermediate chamber 526, and the intermediate chamber 526 is in communication with the control chamber 546 via the third passage 542 formed in the follower valve 541. That is, in this comparative example, in the second member 522, the two passages 525 and 527 need to be in communication with the intermediate chamber 526 that opens toward the follower valve 541 (i.e., toward the control chamber 546). On the other hand, in the present embodiment, in the second member 22, only the first passage 25 is in communication with the intermediate chamber 26 that opens toward the follower valve 41 (i.e., toward the first control chamber 46). Therefore, in the present embodiment, the number of passages in communication with the intermediate chamber 26 in the second member 22 can be reduced, and the configuration near the follower valve 41 can be simplified.

It should be noted that in the configuration in which the needle valve 31 is exposed inside the second control chamber 36, when the fuel pressure inside the second control chamber 36 suddenly decreases, the needle valve 31 is suddenly lifted and repeatedly collides with the third member 23 (or a stopper), and the behavior of the needle valve 31 becomes unstable. On the other hand, if the speed at which the fuel pressure inside the second control chamber 36 decreases is too low, the lifting speed (responsiveness) of the needle valve 31 may be too low.

In this regard, the connection passage 47 has the fourth throttle 47*a* for limiting the flow rate of the fuel. For this reason, the flow rate of the fuel flowing out of the second control chamber 36 is restricted by the fourth throttle 47*a*, and the speed at which the fuel pressure inside the second control chamber 36 decreases is appropriately set. More specifically, in a state in which the first open-close valve 51 is open, the second open-close valve 52 is open, the second high pressure passage 14 and the first control chamber 46 are blocked off from each other by the follower valve 41, and the high pressure chamber 33 is in communication with the injection hole 34 through the needle valve 31, the fuel flow rate through the fourth throttle 47*a* is set to be greater than the total fuel flow rate through the first throttle 42*a* and the second throttle 27*a*. Therefore, the flow rate of the fuel flowing into the first control chamber 46 via the connection passage 47 is larger than the flow rate of the fuel flowing out of the first control chamber 46 via the third passage 42 and the second passage 27. Therefore, it is possible to prevent the fuel pressure inside the first control chamber 46 from excessively decreasing, and to avoid a decrease in the pressure difference in the fuel before and after the first throttle 42*a*. Further, the transmission of pulsations of fuel pressure between the first control chamber 46 and the second control chamber 36 is reduced by the fourth throttle 47*a*.

When the needle valve 31 lifts and collides with the third member 23 (or the stopper), the behavior of the needle valve 31 becomes unstable. For this reason, in the present embodiment, the full lift limit is set as the lift amount when the needle valve 31 collides with the third member 23 (or the stopper), and control is performed such that the lift amount of the needle valve 31 is smaller than the full lift limit. Specifically, when the lift amount of the needle valve 31 reaches just before the full lift limit, the needle valve 31 is shifted to a valve closing operation so as to reduce the lift amount. At this time, the amount of fuel that can be injected by the fuel injection valve 20 is a maximum value.

Figure 7:
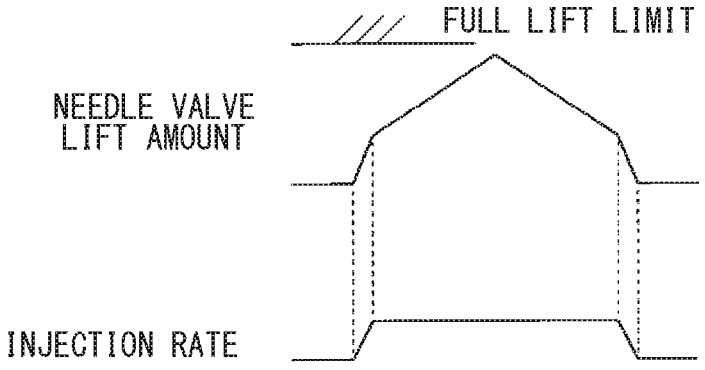
FIG. 7 is a graph showing a relationship between a lift amount and an injection rate of a needle valve.

FIG. 7 is a graph showing a relationship between a lift amount and an injection rate of a needle valve 31. Here, the ECU 90 controls the injection rate to rise (increase) at a high speed at the start of the injection, controls the injection rate to fall (decrease) at a high speed at the end of the injection, and to maximize the amount of injected fuel. Specifically, the ECU 90 opens the first open-close valve 51 and the second open-close valve 52 to start fuel injection, and when the injection rate reaches the maximum rate (i.e., when the injection hole 34 is fully opened), the second open-close valve 52 is closed. Then, immediately before the lift amount of the needle valve 31 reaches the full lift limit, the first open-close valve 51 is closed and the second open-close valve 52 is opened. Thereafter, when the lift amount of the needle valve 31 decreases to the point where the injection rate starts to decrease, the second open-close valve 52 is closed. Here, the amount of fuel to be injected is the area under the curve in injection rate graph (i.e., a value obtained by integrating the injection rate curve).

Figure 8:
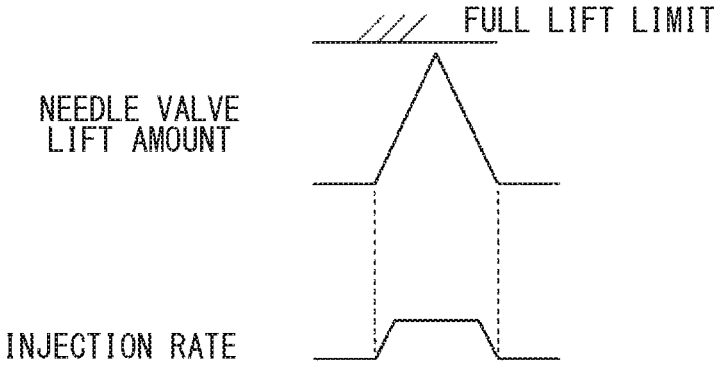
FIG. 8 is a graph showing a relationship between a lift amount and an injection rate of a needle valve of a comparative example.

FIG. 8 is a graph showing a relationship between a lift amount and an injection rate of a needle valve of a comparative example. Here, too, the injection rate is raised at a high speed at the start of injection, the injection rate is lowered at a high speed at the end of injection, and the amount of injected fuel is controlled to a maximum value. However, in the comparative example, the speed at which the needle valve lifts and the speed at which the needle valve descends cannot be changed. Therefore, the time required for the lift amount of the needle valve to reach the full lift limit is shortened, and the amount of fuel that can be injected is reduced.

Figure 9:
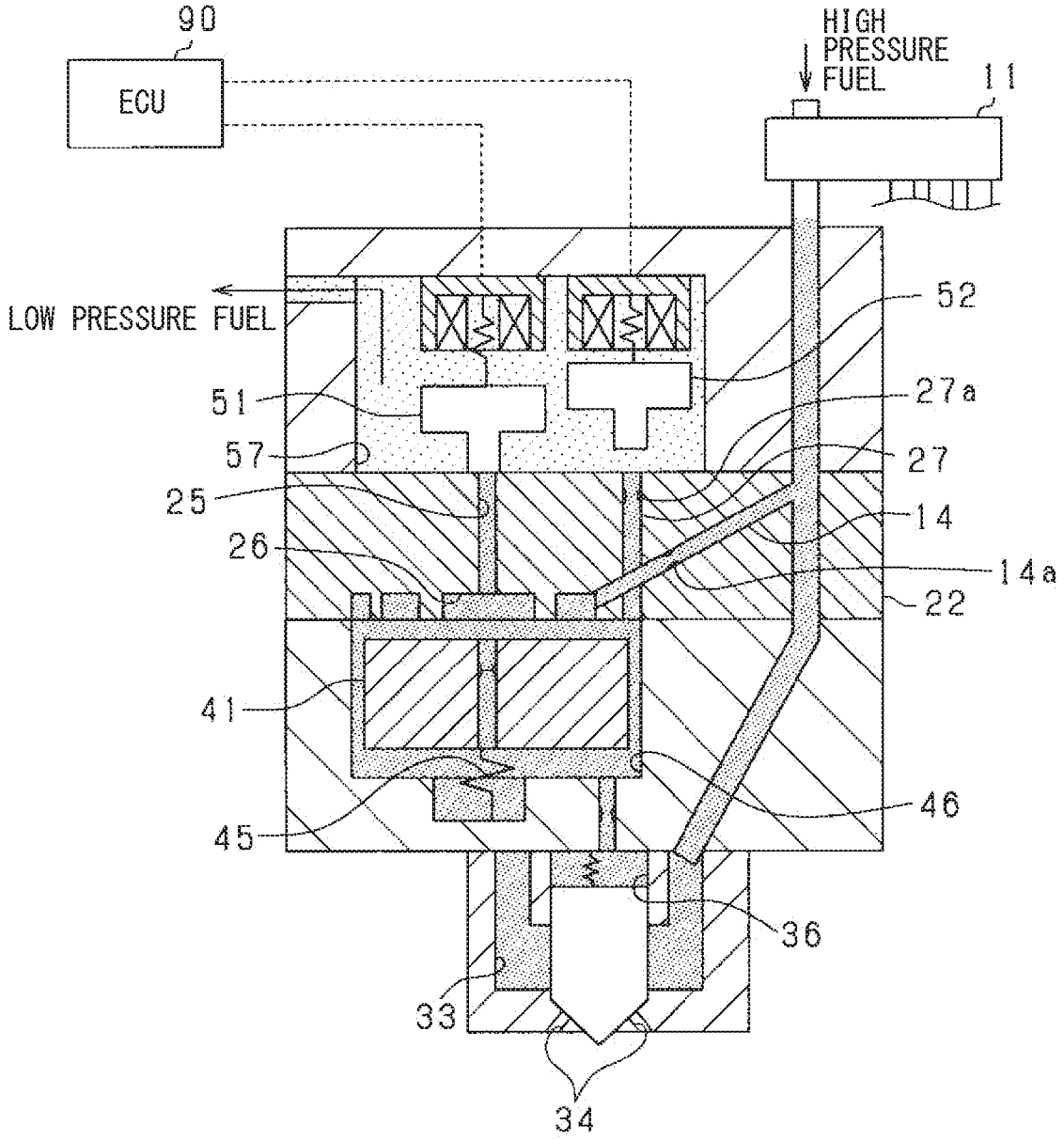
FIG. 9 is a schematic diagram showing a pressure reducing operation by a second open-close valve.

FIG. 9 is a schematic diagram showing a pressure reducing operation for reducing the fuel pressure in the common rail 11 by the second open-close valve 52 without injecting the fuel by the fuel injection valve 20.

As described above, when the first open-close valve 51 and the second open-close valve 52 are closed, the fuel pressure inside each of the second control chamber 36, the first control chamber 46, the intermediate chamber 26, the first passage 25, and the second passage 27 is at a balanced high pressure. The follower valve 41 is biased by the spring 45 to abut the second member 22. In the pressure reducing operation, the ECU 90 opens the second open-close valve 52 from this state. As a result, the fuel inside the first control chamber 46 is discharged through the second passage 27. Since the follower valve 41 is not attracted to the intermediate chamber 26, when the fuel pressure inside the first control chamber 46 decreases, the follower valve 41 separates from the second member 22 due to the fuel pressure inside the second high pressure passage 14.

Here, in a state where the first open-close valve 51 is closed and the second open-close valve 52 is open, the flow rate of the fuel through the third throttle 14*a* is set to be larger than the flow rate of the fuel through the second throttle 27*a*. Therefore, the amount of fuel flowing from the second high pressure passage 14 into the first control chamber 46 is larger than the amount of fuel discharged from the inside of the first control chamber 46. Therefore, the fuel pressure inside the first control chamber 46 does not decrease, and the state where the high pressure chamber 33 and the injection hole 34 are blocked off from each other by the needle valve 31 is maintained. Then, fuel flows from the common rail 11 into the first control chamber 46 via the first high pressure passage 13 and the second high pressure passage 14, so that the fuel pressure inside the common rail 11 decreases. That is, the fuel pressure in the common rail 11 is reduced in a state where the fuel is not injected by the fuel injection valve 20.

Next, a specific example of the relationship between the rising speed and the falling speed of the injection rate and the open/closed state of the open-close valves 51 and 52 will be described.

Figure 10:
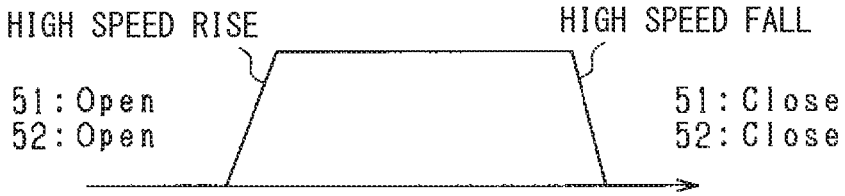
FIG. 10 is a graph showing injection rate patterns for high speed rise and at the time of high speed fall.
Figure 11:
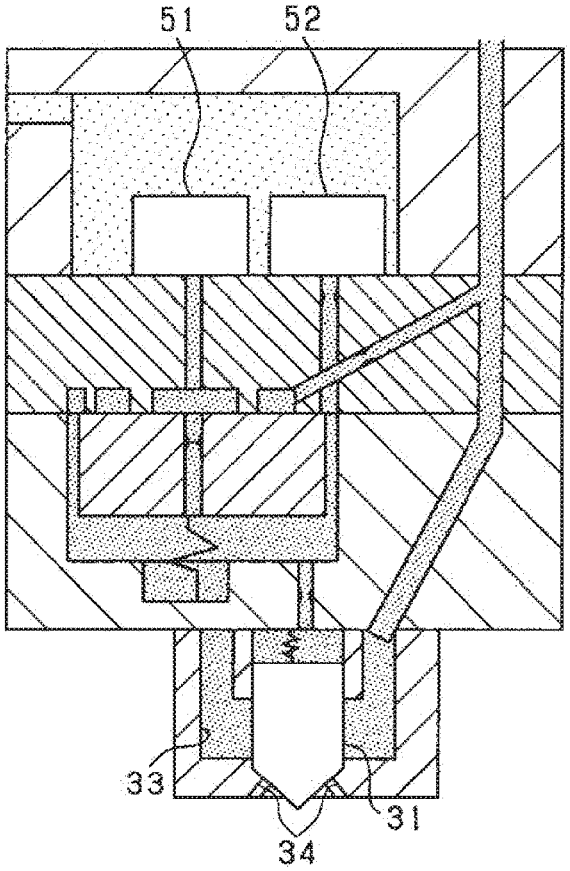
FIG. 11 is a schematic view showing the states of a first open-close valve and a second open-close valve before the start of injection.
Figure 12:
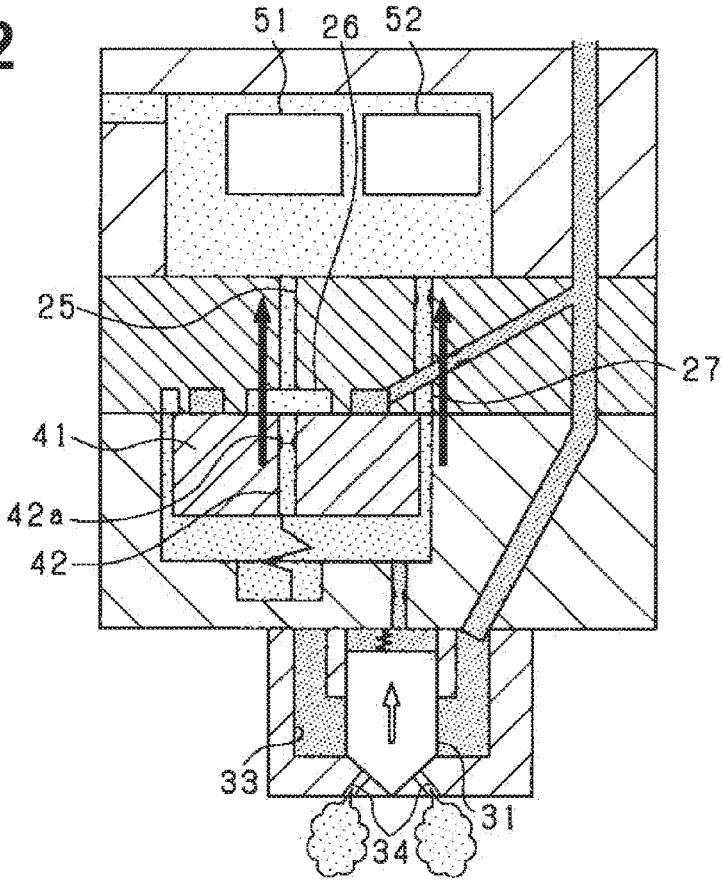
FIG. 12 is a schematic view showing the states of a first open-close valve and a second open-close valve at the time of high speed rise.

FIG. 10 is a graph showing injection rate patterns for high speed rise and for high speed fall. Before the start of the injection, as shown in FIG. 11, the first open-close valve 51 and the second open-close valve 52 are both closed, and communication between the high pressure chamber 33 and the injection hole 34 is blocked off by the needle valve 31. As shown in FIG. 12, when the first open-close valve 51 and the second open-close valve 52 are both opened, the fuel inside the first control chamber 46 passes through the third passage 42, the first passage 25, and the second passage 27, and is discharged. At this time, a pressure difference is generated in the fuel before and after the first throttle 42*a*, and the follower valve 41 is attracted to the intermediate chamber 26. As a result, the fuel pressure inside the first control chamber 46 decreases at a high speed, and the needle valve 31 lifts at a high speed. Therefore, as shown in FIG. 10, the injection rate increases at a high speed.

Figure 13:
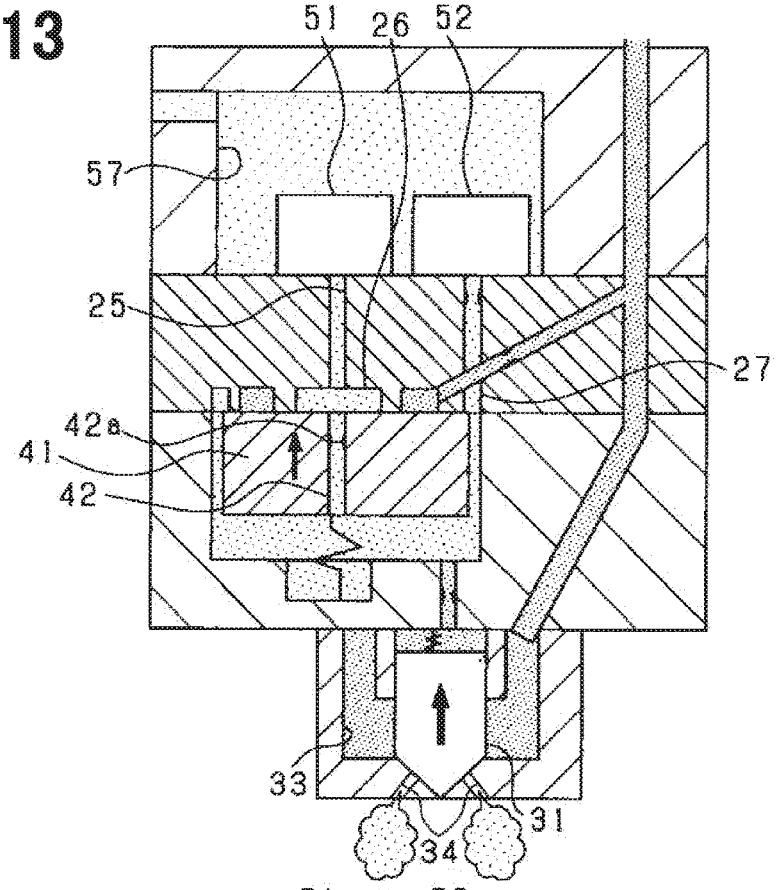
FIG. 13 is a schematic view showing the states of a first open-close valve and a second open-close valve at the time of high speed fall.
Figure 14:
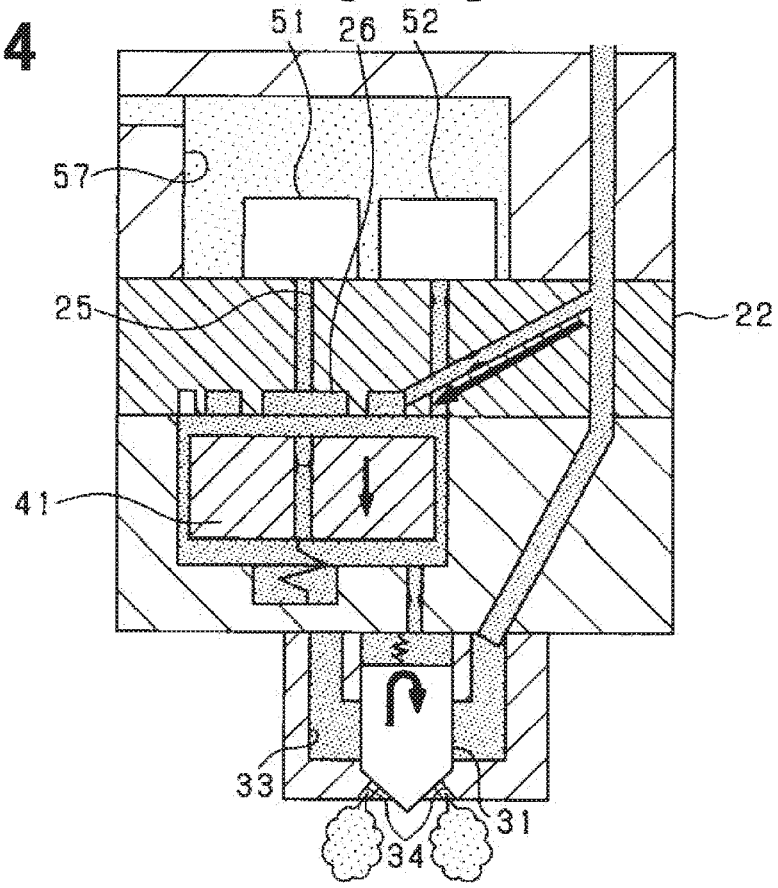
FIG. 14 is a schematic view showing the states of a first open-close valve, a second open-close valve, and a follower valve at the time of high speed fall.

After the injection rate reaches its maximum value, as shown in FIG. 13, the first open-close valve 51 is closed. As a result, fuel flows into the intermediate chamber 26 through the first throttle 42*a* of the third passage 42, and the fuel pressure in the intermediate chamber 26 increases. In addition, the second open-close valve 52 is closed, which blocks the communication between the second passage 27 and the low pressure chamber 57. Thereafter, when the fuel pressure inside the intermediate chamber 26 increases and the force with which the follower valve 41 is attracted to the intermediate chamber 26 decreases, the follower valve 41 separates from the intermediate chamber 26 as shown in FIG. 14. Therefore, the second high pressure passage 14 and the first control chamber 46 are in communication with each other, and the fuel pressure inside the first control chamber 46 increases at a high speed. When fuel flows from the first control chamber 46 to the second control chamber 36 via the connection passage 47 and the fuel pressure inside the second control chamber 36 exceeds a predetermined pressure, the needle valve 31 starts to descend, and begins a valve closing operation. Since the fuel pressure inside the first control chamber 46 rises at a high speed, the injection rate falls at a high speed as shown in FIG. 10.

Figure 15:
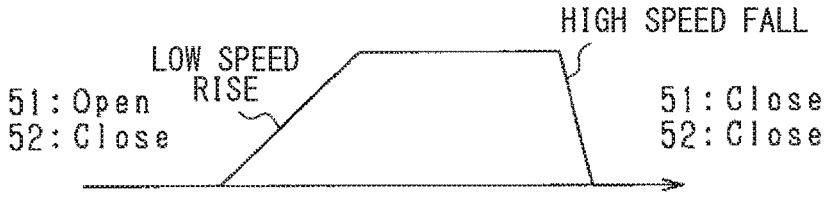
FIG. 15 is a graph showing injection rate patterns for low speed rise and at the time of high speed fall.
Figure 16:
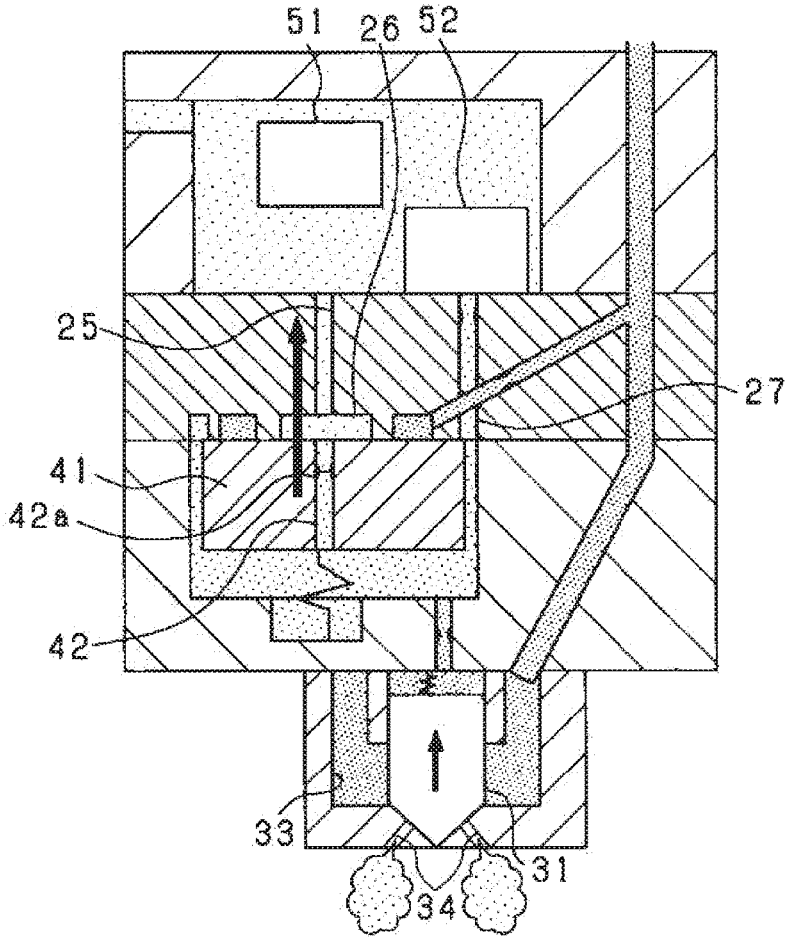
FIG. 16 is a schematic view showing the states of a first open-close valve and a second open-close valve at the time of low speed rise.

FIG. 15 is a graph showing injection rate patterns for low speed rise and high speed fall. As shown in FIG. 16, when the second open-close valve 52 is maintained closed and the first open-close valve 51 is opened, the fuel inside the first control chamber 46 passes through the third passage 42 and the first passage 25, and is discharged. At this time, a pressure difference is generated in the fuel before and after the first throttle 42*a*, and the follower valve 41 is attracted to the intermediate chamber 26. Thus, the fuel pressure inside the first control chamber 46 decreases at a low speed, and the needle valve 31 lifts at a low speed. Therefore, as shown in FIG. 15, the injection rate rises at a low speed. After the injection rate reaches its maximum value, the operation is the same as the operation for high speed fall shown in FIG. 10.

Figure 17:
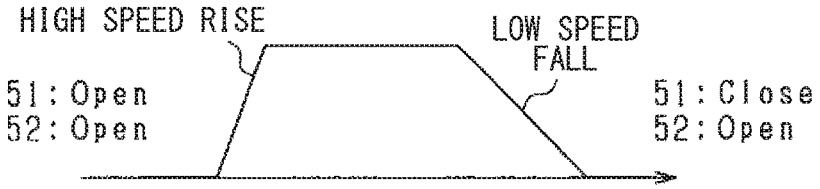
FIG. 17 is a graph showing injection rate patterns for high speed rise and at the time of low speed fall.

FIG. 17 is a graph showing injection rate patterns for high speed rise and low speed fall. The operation for high speed rise in this case is the same as the operation for high speed rise shown in FIG. 10.

Figure 18:
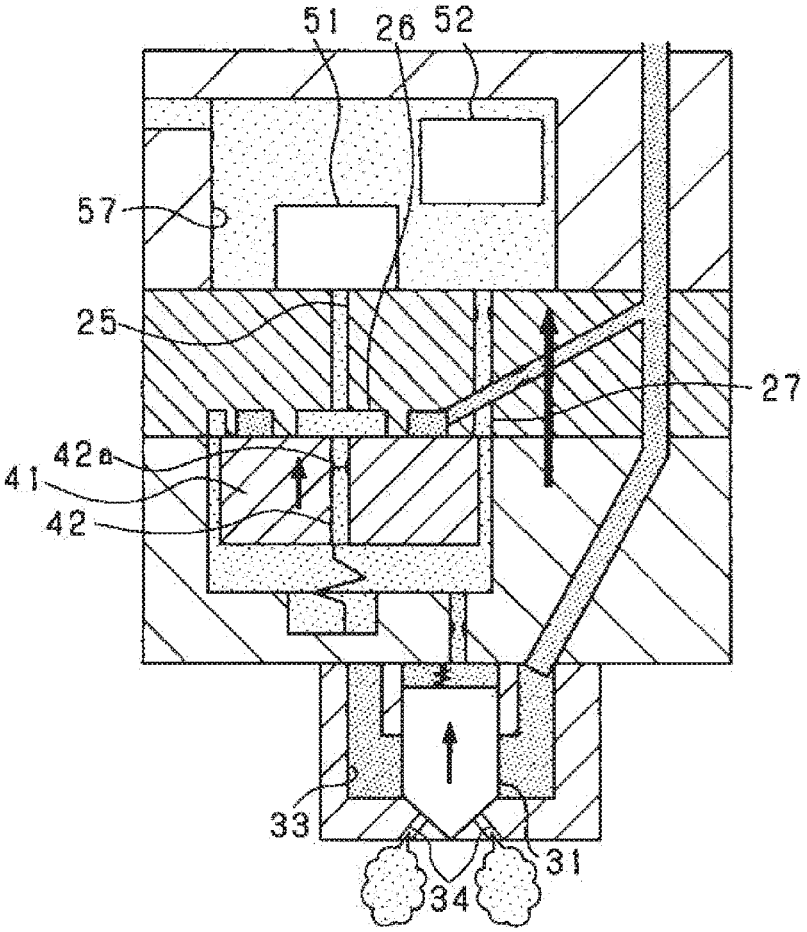
FIG. 18 is a schematic view showing the states of a first open-close valve and a second open-close valve at the time of low speed fall.
Figure 19:
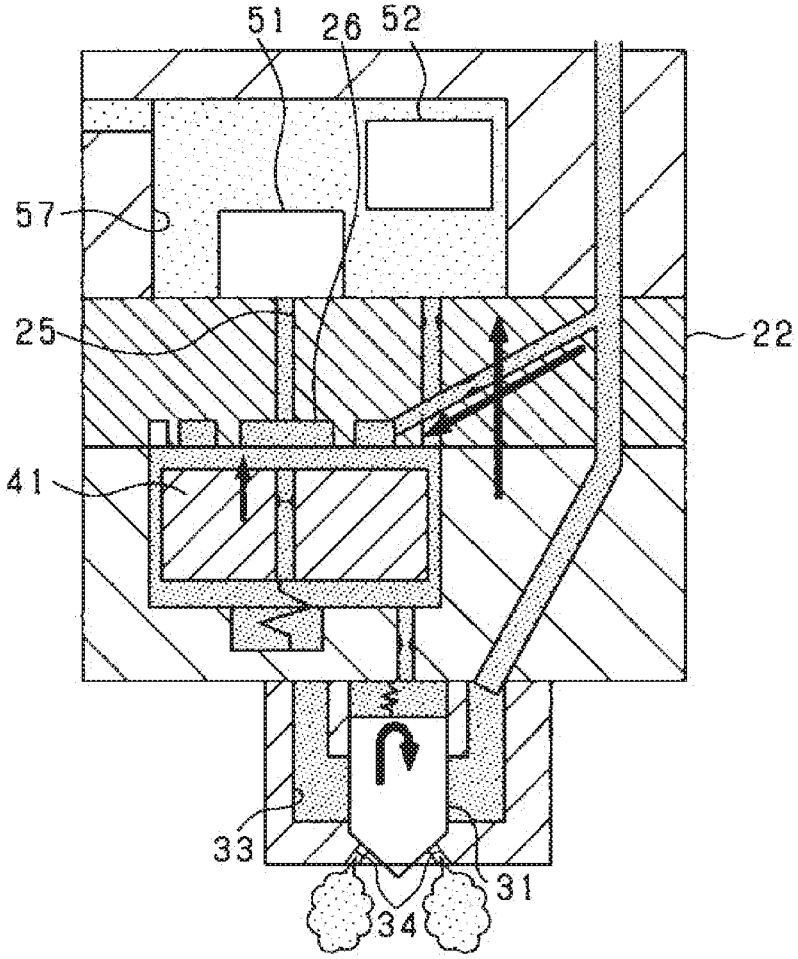
FIG. 19 is a schematic view showing the states of a first open-close valve, a second open-close valve, and a follower valve at the time of low speed fall.

After the injection rate reaches its maximum value, as shown in FIG. 18, the second open-close valve 52 is maintained in the open state, while the first open-close valve 51 is closed. As a result, fuel flows into the intermediate chamber 26 through the first throttle 42*a* of the third passage 42, and the fuel pressure in the intermediate chamber 26 increases. The second passage 27 is in communication with the low pressure chamber 57, and the fuel inside the first control chamber 46 is discharged through the second passage 27. Thereafter, when the fuel pressure inside the intermediate chamber 26 increases and the force with which the follower valve 41 is attracted to the intermediate chamber 26 decreases, the follower valve 41 separates from the intermediate chamber 26 as shown in FIG. 19. Therefore, the second high pressure passage 14 and the first control chamber 46 are in communication with each other, and the fuel pressure inside the first control chamber 46 increases at a low speed. When fuel flows from the first control chamber 46 to the second control chamber 36 via the connection passage 47 and the fuel pressure inside the second control chamber 36 exceeds a predetermined pressure, the needle valve 31 starts to descend, and begins a valve closing operation. Since the fuel pressure inside the first control chamber 46 rises at a low speed, the injection rate falls at a low speed as shown in FIG. 17.

Figure 20:
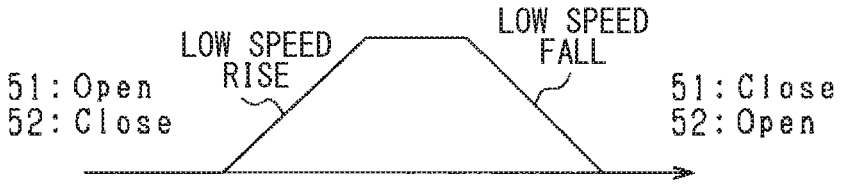
FIG. 20 is a graph showing injection rate patterns for low speed rise and at the time of low speed fall.

FIG. 20 is a graph showing injection rate patterns for low speed rise and low speed fall. The operation for low speed rise in this case is the same as the operation for low speed rise shown in FIG. 15. The operation for low speed fall in this case is the same as the operation for low speed fall shown in FIG. 17.

Figure 21:
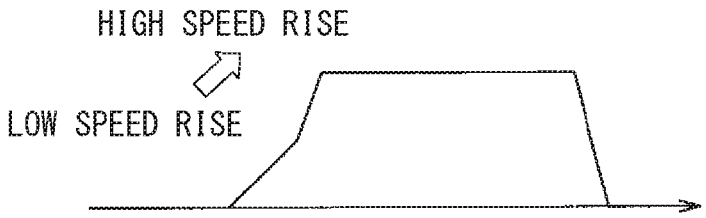
FIG. 21 is a graph showing an injection rate pattern when changing from low speed rise to high speed rise.

FIG. 21 is a graph showing an injection rate pattern when changing from low speed rise to high speed rise. The operation for low speed rise in this case is the same as the operation for low speed rise shown in FIG. 15. Then, while the needle valve 31 is being lifted (i.e., moving in a direction of allowing communication between the high pressure chamber 33 and the injection hole 34), the ECU 90 shifts to the operation for high speed rise. That is, the ECU 90 performs a transition from the state where the first open-close valve 51 is open and the second open-close valve 52 is closed as shown in FIG. 16 to the state where both the first open-close valve 51 and the second open-close valve 52 are open as shown in FIG. 12. The subsequent operation for high speed rise is the same as the operation for high speed rise shown in FIG. 10.

Figure 22:
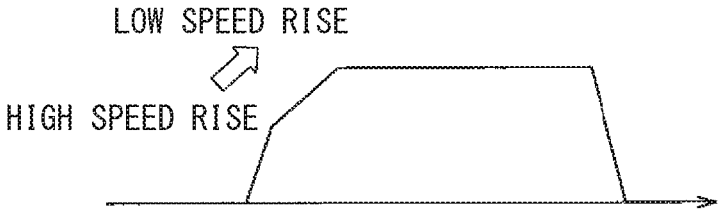
FIG. 22 is a graph showing an injection rate pattern when changing from high speed rise to low speed rise.

FIG. 22 is a graph showing an injection rate pattern when changing from high speed rise to low speed rise. The operation for high speed rise in this case is the same as the operation for high speed rise shown in FIG. 10. Then, while the needle valve 31 is being lifted, the ECU 90 shifts to the operation for low speed rise. That is, the ECU 90 performs a transition from the state where the first open-close valve 51 and the second open-close valve 52 are both open as shown in FIG. 12 to the state where the first open-close valve 51 is open while the second open-close valve 52 is closed as shown in FIG. 16. The subsequent operation for low speed rise is the same as the operation for low speed rise shown in FIG. 15.

Figure 23:
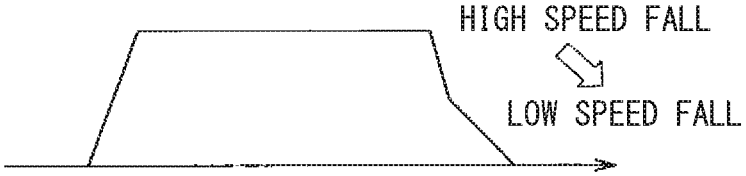
FIG. 23 is a graph showing an injection rate pattern when changing from high speed fall to low speed fall.

FIG. 23 is a graph showing an injection rate pattern when changing from high speed fall to low speed fall. The description of the operation from rise until reaching maximum injection rate is omitted. The subsequent operation for high speed fall is the same as the operation for high speed fall shown in FIG. 10. Then, while the needle valve 31 is moving down (moving in a direction to block communication between the high pressure chamber 33 and the injection hole 34), the ECU 90 shifts to the operation for low speed falling. That is, the ECU 90 performs a transition from the state where the first open-close valve 51 and the second open-close valve 52 are both closed as shown in FIG. 14 to the state where the first open-close valve 51 is closed while the second open-close valve 52 is open as shown in FIG. 19. The subsequent operation for low speed fall is the same as the operation for low speed fall shown in FIG. 17.

Figure 24:
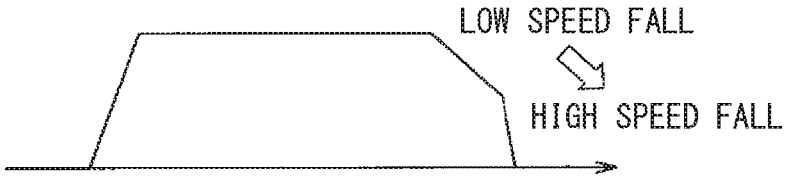
FIG. 24 is a graph showing an injection rate pattern when changing from low speed fall to high speed fall.

FIG. 24 is a graph showing an injection rate pattern when changing from low speed fall to high speed fall. The description of the operation from rise until reaching maximum injection rate is omitted. The subsequent operation for low speed fall is the same as the operation for low speed fall shown in FIG. 17. Then, while the needle valve 31 is descending, the ECU 90 shifts to the operation for high speed falling. That is, the ECU 90 performs a transition from the state where the first open-close valve 51 is closed while the second open-close valve 52 is open as shown in FIG. 19 to the state where the first open-close valve 51 and the second open-close valve 52 are both closed as shown in FIG. 14. The subsequent operation for high speed fall is the same as the operation for high speed fall shown in FIG. 10.

The ECU 90 controls the open/closed state of the open-close valves 51 and 52 and therefore the gradient of the fuel injection rate by the fuel injection valve 20 based on the operating state of the engine in which the fuel injection valve 20 is mounted and the fuel pressure in the common rail 11. As the operation state of the engine, for example, the load of the engine, the rotation speed of the engine, air-fuel ratio, and the like can be used. Further, the ECU 90 may correct the timing for switching the open/closed state of the open-close valves 51 and 52 according to the responsiveness of the needle valve 31 due to individual differences and the temperature of the fuel injection valves 20.

Further, while the needle valve 31 is rising, the ECU 90 can also switch the open/closed state of the open-close valves 51 and 52 between the state shown in FIG. 12 and the state shown in FIG. 16 a plurality of times or continuously. In that case, during the lift of the needle valve 31, the rising speed (gradient) of the fuel injection rate can be changed in multiple stages or continuously. Further, while the needle valve 31 is falling, the ECU 90 can also switch the open/closed state of the open-close valves 51 and 52 between the state shown in FIG. 14 and the state shown in FIG. 19 a plurality of times or continuously. In that case, during the fall of the needle valve 31, the falling speed (gradient) of the fuel injection rate can be changed in multiple stages or continuously.

Figure 25:
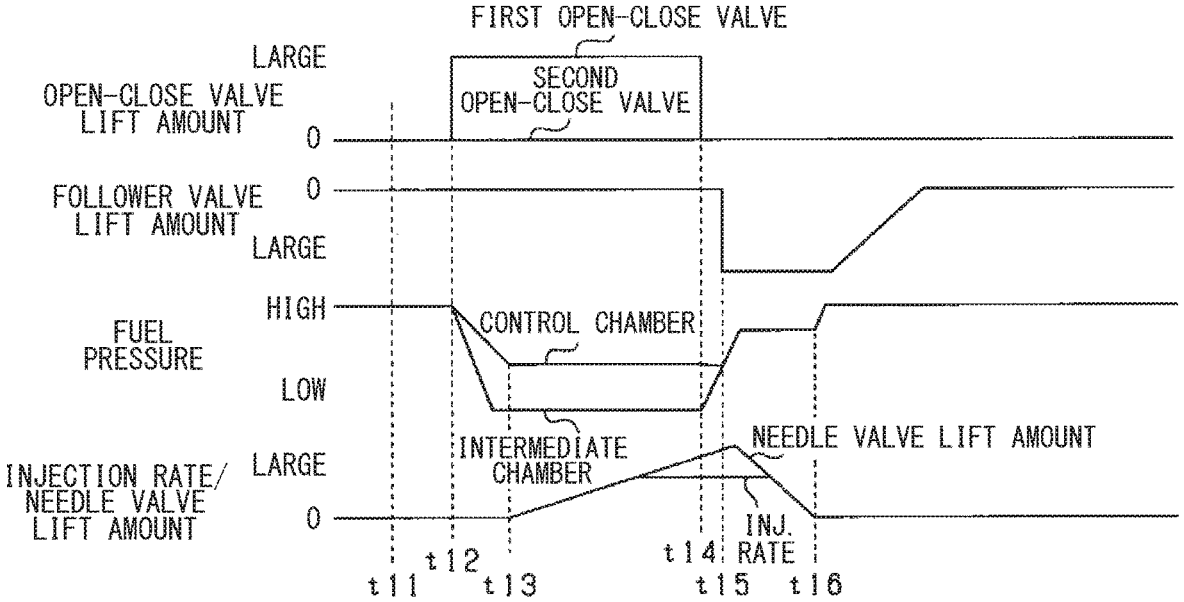
FIG. 25 is a time chart showing operations for low speed rise and at the time of high speed fall.

FIG. 25 is a time chart showing the operation for low speed rise and high speed rise. Here, for convenience of explanation, it is assumed that the fuel pressure inside the first control chamber 46 and the fuel pressure inside the second control chamber 36 are equal.

At time t11, the first open-close valve 51 and the second open-close valve 52 are both closed, the lift amount of the follower valve 41 is 0, the fuel pressure inside the control chambers 46 and 36 and the intermediate chamber 26 is high, and the lift amount and injection rate of the needle valve 31 are zero. At this time, the leakage of fuel from the first passage 25 to the low pressure chamber 57 is zero, and the leakage of fuel from the second passage 27 to the low pressure chamber 57 is zero. In other words, in a state where the fuel is not injected, the fuel injection valve 20 can reduce the fuel leakage from the high pressure side to the low pressure side of the fuel passages to zero, and thus reduce the energy for supplying the fuel to the common rail 11.

At time t12, when the first open-close valve 51 is opened, the fuel pressure inside the intermediate chamber 26 and the control chambers 46, 36 decreases. Here, since the third passage 42 has the first throttle 42*a*, the fuel pressure inside the intermediate chamber 26 drops faster than the fuel pressure inside the control chambers 46 and 36. At this time, the amount of fuel flowing from the high pressure passages 13 and 14 into the first control chamber 46 and the second control chamber 36 is zero. Therefore, even when the flow rate of fuel from the first passage 25 to the low pressure chamber 57 is small, the fuel pressure inside the control chambers 46 and 36 can be reduced at a required speed, and the needle valve 31 can be lifted with a required responsivity.

At time t13, when the fuel pressure inside the second control chamber 36 becomes lower than the predetermined pressure, the needle valve 31 begins to lift. Since the fuel inside the first control chamber 46 is discharged through the first passage 25 but not through the second passage 27, the fuel pressure inside the control chambers 46 and 36 decreases at a low speed. Here, the amount of fuel discharged from the second control chamber 36 is balanced by the amount of decrease in the volume of the second control chamber 36 due to the lift of the needle valve 31. As a result, the fuel pressure inside the second control chamber 36 remains constant. That is, since the volume of the second control chamber 36 decreases at a low speed, the needle valve 31 is lifted at a low speed, and the injection rate rises at a low speed. At this time as well, the amount of fuel flowing from the high pressure passages 13 and 14 into the first control chamber 46 and the second control chamber 36 is zero.

At time t14, when the first open-close valve 51 is closed, the fuel pressure inside the intermediate chamber 26 begins to increase. At this time, the leakage of fuel from the first passage 25 to the low pressure chamber 57 is zero, and the leakage of fuel from the second passage 27 to the low pressure chamber 57 is zero. At time t15, when the difference between the fuel pressure inside the control chambers 46 and 36 and the fuel pressure inside the intermediate chamber 26 decreases, the follower valve 41 begins to separate from the second member 22. As a result, high pressure fuel flows from the second high pressure passage 14 into the first control chamber 46. At this time as well, the leakage of fuel from the first passage 25 to the low pressure chamber 57 is zero, and the leakage of fuel from the second passage 27 to the low pressure chamber 57 is zero. Therefore, the fuel flowing from the second high pressure passage 14 into the first control chamber 46 and the second control chamber 36 can efficiently increase the fuel pressure inside the second control chamber 36.

Thereafter, when the fuel pressure inside the second control chamber 36 becomes higher than the predetermined pressure, the needle valve 31 starts to falls. Since the fuel inside the first control chamber 46 is not discharged from the first passage 25 and is not discharged from the second passage 27, the fuel pressure inside the control chambers 46 and 36 increases at a high speed. At this time, the leakage of fuel from the first passage 25 to the low pressure chamber 57 is zero, and the leakage of fuel from the second passage 27 to the low pressure chamber 57 is zero. Here, the amount of fuel flowing into the second control chamber 36 is balanced by the amount of increase in the volume of the second control chamber 36 due to the fall of the needle valve 31. As a result, the fuel pressure inside the second control chamber 36 remains constant. That is, since the volume of the second control chamber 36 increases at a high speed, the needle valve 31 falls at a high speed, and the injection rate falls at a high speed. At this time as well, the leakage of fuel from the first passage 25 to the low pressure chamber 57 is zero, and the leakage of fuel from the second passage 27 to the low pressure chamber 57 is zero.

At time t16, the high pressure chamber 33 and the injection hole 34 are blocked off by the needle valve 31, and the fuel pressure inside the control chambers 46 and 36 begins to increase. Thereafter, the fuel pressure inside the first control chamber 46 and the fuel pressure inside the intermediate chamber 26 are balanced at a high pressure, and the follower valve 41 is biased by the spring 45 so that the follower valve 41 comes into contact with the second member 22.

Figure 26:
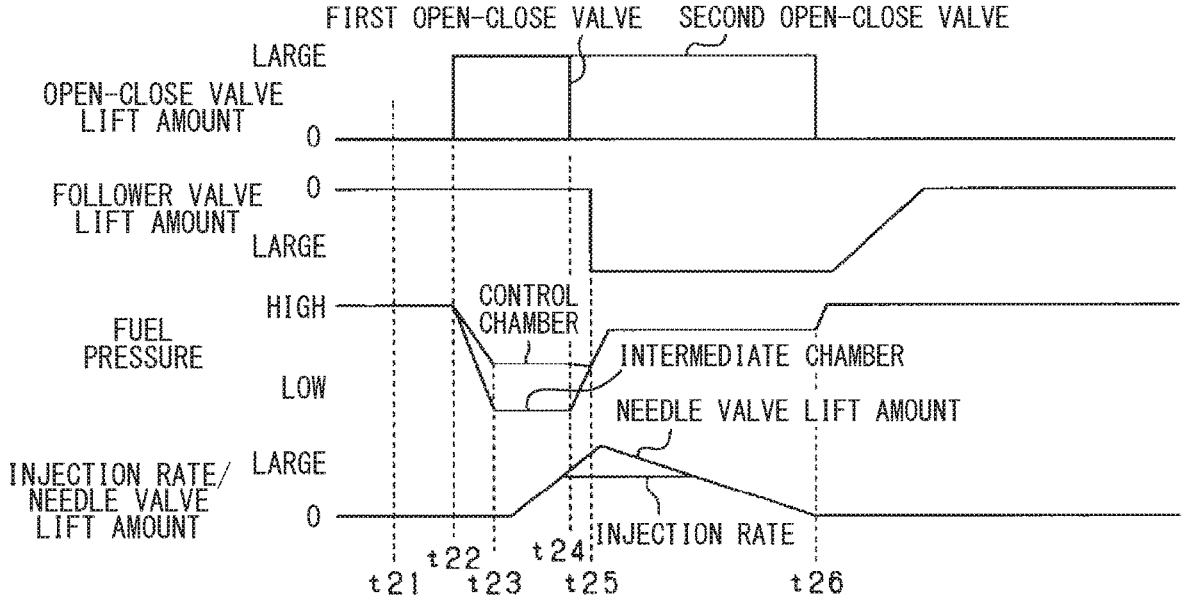
FIG. 26 is a time chart showing operations for high speed rise and at the time of low speed fall.

FIG. 26 is a time chart showing operations for high speed rise and low speed fall.

At time t21, the first open-close valve 51 and the second open-close valve 52 are both closed, the lift amount of the follower valve 41 is 0, the fuel pressure inside the control chambers 46 and 36 and the intermediate chamber 26 is high, and the lift amount and injection rate of the needle valve 31 are zero. At this time, the leakage of fuel from the first passage 25 to the low pressure chamber 57 is zero, and the leakage of fuel from the second passage 27 to the low pressure chamber 57 is zero.

At time t22, when both the first open-close valve 51 and the second open-close valve 52 are opened, the fuel pressure inside the intermediate chamber 26 and the control chambers 46, 36 begins to decrease. At this time, the amount of fuel flowing from the high pressure passages 13 and 14 into the first control chamber 46 and the second control chamber 36 is zero.

At time t23, when the fuel pressure inside the second control chamber 36 becomes lower than the predetermined pressure, the needle valve 31 begins to lift. Since the fuel inside the first control chamber 46 is discharged through the first passage 25 and the second passage 27, the fuel pressure inside the control chambers 46 and 36 decreases at high speed. That is, since the volume of the second control chamber 36 decreases at a high speed, the needle valve 31 is lifted at a high speed, and the injection rate rises at a high speed. At this time as well, the amount of fuel flowing from the high pressure passages 13 and 14 into the first control chamber 46 and the second control chamber 36 is zero.

At time t24, when the second open-close valve 52 is kept open and the first open-close valve 51 is closed, the fuel pressure inside the intermediate chamber 26 begins to increase. At time t25, when the difference between the fuel pressure inside the control chambers 46 and 36 and the fuel pressure inside the intermediate chamber 26 decreases, the follower valve 41 begins to separate from the second member 22. As a result, high pressure fuel flows from the second high pressure passage 14 into the first control chamber 46.

Thereafter, when the fuel pressure inside the second control chamber 36 becomes higher than the predetermined pressure, the needle valve 31 starts to falls. Since the fuel inside the first control chamber 46 is not discharged from the first passage 25 but is discharged from the second passage 27, the fuel pressure inside the control chambers 46 and 36 increases at a low speed. That is, since the volume of the second control chamber 36 increases at a low speed, the needle valve 31 falls at a low speed, and the injection rate falls at a low speed.

At time t26, the high pressure chamber 33 and the injection hole 34 are blocked off by the needle valve 31, and the fuel pressure inside the control chambers 46 and 36 begins to increase. Thereafter, the second open-close valve 52 is closed, and the fuel pressure inside the first control chamber 46 and the fuel pressure inside the intermediate chamber 26 are balanced at a high pressure. Then, the follower valve 41 is biased by the spring 45, and the follower valve 41 abuts the second member 22. At this time, the leakage of fuel from the first passage 25 to the low pressure chamber 57 is zero, and the leakage of fuel from the second passage 27 to the low pressure chamber 57 is zero.

Figure 27:
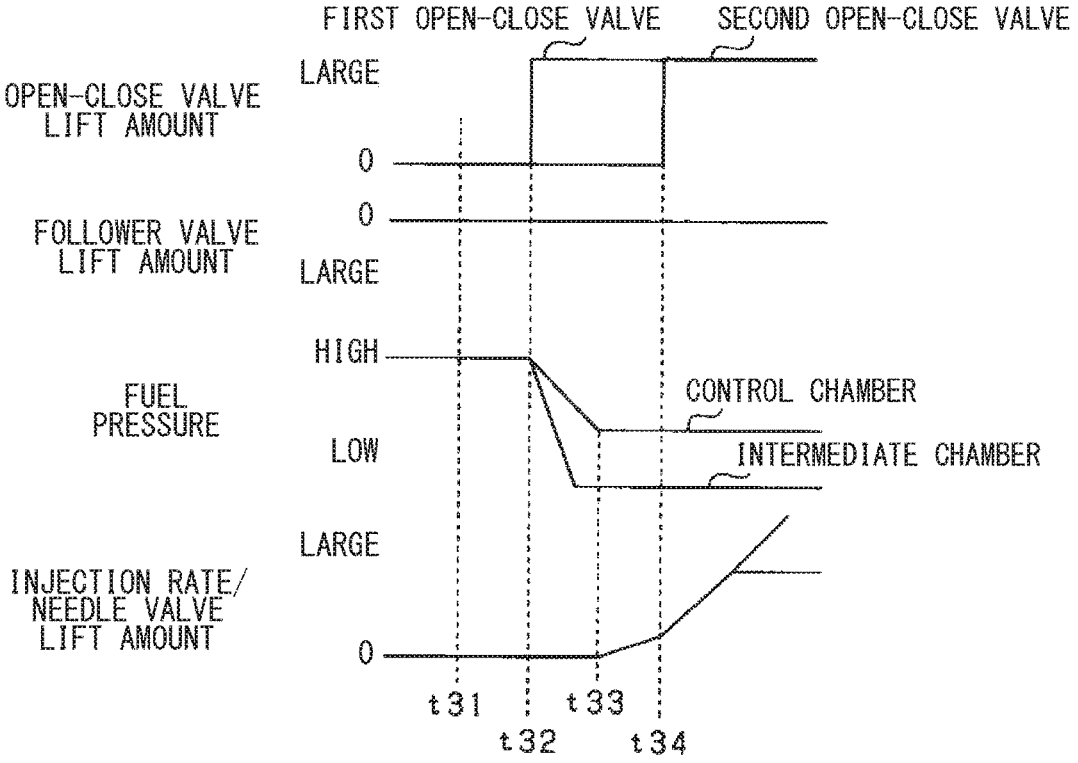
FIG. 27 is a time chart showing an operation when changing from low speed rise to high speed rise.

FIG. 27 is a time chart showing an operation when changing from low speed rise to high speed rise. The operation from time t31 to t33 is the same as the operation from time t11 to t13 in FIG. 25.

At time t34, the second open-close valve 52 is opened while the needle valve 31 is being lifted (i.e., while the injection rate is increasing). Due to this, since the fuel inside the first control chamber 46 is discharged through the first passage 25 and the second passage 27, the fuel pressure inside the control chambers 46 and 36 decreases at high speed. That is, since the volume of the second control chamber 36 decreases at a high speed, the needle valve 31 is lifted at a high speed, and the injection rate rises at a high speed. As a result, while the needle valve 31 is being lifted, the injection rate changes from low speed rise to high speed rise. At this time, the amount of fuel flowing from the high pressure passages 13 and 14 into the first control chamber 46 and the second control chamber 36 is zero.

Figure 28:
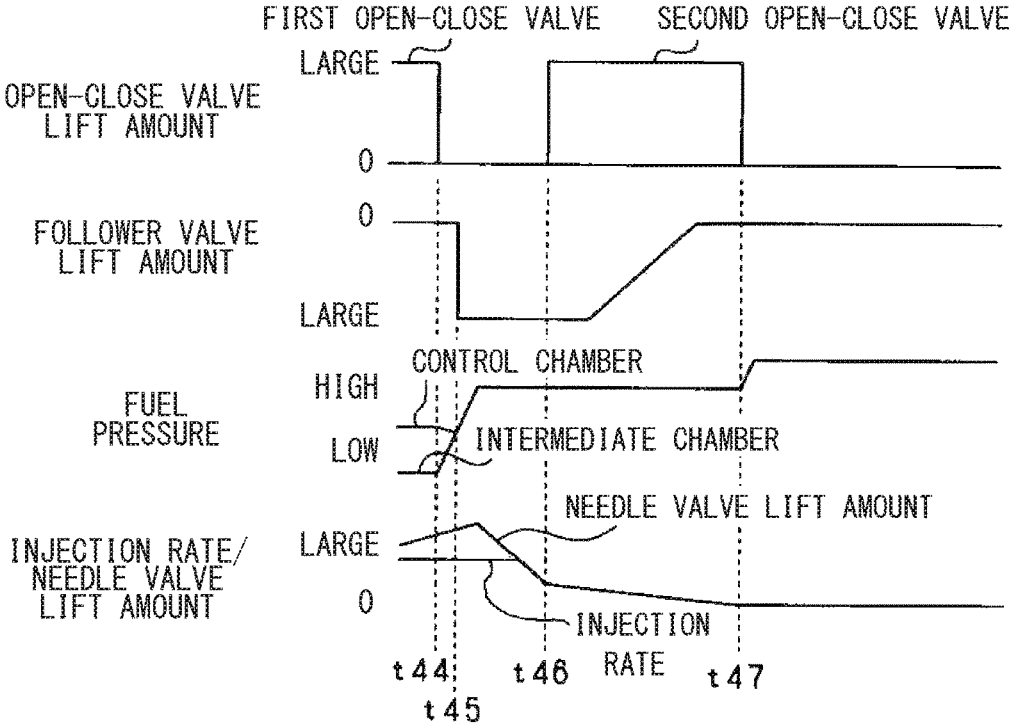
FIG. 28 is a time chart showing an operation when changing from high speed fall to low speed fall.

FIG. 28 is a time chart showing an operation when changing from high speed fall to low speed fall. The operation prior to time t45 is the same as the operation prior to time t15 in FIG. 25.

At time t46, the second open-close valve 52 is opened while the needle valve 31 is falling (i.e., while the injection rate is decreasing). As a result, the fuel inside the first control chamber 46 is discharged through the second passage 27, so that the fuel pressure inside the control chambers 46 and 36 increases at a low speed. That is, since the volume of the second control chamber 36 increases at a low speed, the needle valve 31 falls at a low speed, and the injection rate falls at a low speed. As a result, while the needle valve 31 is falling, the injection rate changes from high speed fall to low speed fall.

The present embodiment described above in detail has the following advantages.

When the first passage 25 and the second passage 27 are in communication with the low pressure passage 58 due to the open-close valves 51 and 52, the fuel in the first control chamber 46 is discharged through the first passage 25, the second passage 27, and the low pressure passage 58. Here, since the second passage 27 includes the second throttle 27*a* which restricts fuel flow rate, the fuel pressure inside the first control chamber 46 is maintained at an equal or higher level than the fuel pressure inside the intermediate chamber 26. As a result, the state where the follower valve 41 is attracted to the intermediate chamber 26 is maintained. When the fuel inside the first control chamber 46 is discharged from both the first passage 25 and the second passage 27, the speed at which the fuel pressure in the first control chamber 46 decreases is greater as compared to when the fuel inside the first control chamber 46 is discharged only from the first passage 25. Therefore, the speed at which the needle valve 31 lifts can be increased, and the gradient of the fuel injection rate can be increased. Accordingly, during a state in which the first passage 25 and the low pressure passage 58 are in communication with each other through the first open-close valve 51, the gradient of the fuel injection rate can be controlled by controlling the second open-close valve 52 to allow or block communication between the second passage 27 and the low pressure passage 58.

Since the second passage 27 is in communication with the first control chamber 46 without passing through the follower valve 41, the structure for allowing communication between the second passage 27 and the first control chamber 46 can be simplified. That is, the fuel injection valve 20 does not need to be configured such that the first passage 25 and the second passage 27 are in communication with the first control chamber 46 via two respective passages formed in the follower valve 41. Additionally, the fuel injection valve 20 does not need to be configured such that the first passage 25 and the second passage 27 are in communication with the intermediate chamber 26 and such that the intermediate chamber 26 is in communication with the first control chamber 46 via one passage formed in the follower valve 41. Therefore, the fuel injection valve 20 can control the gradient of the fuel injection rate while also simplifying structure around the follower valve 41.

The fuel injection valve 20 includes the first open-close valve 51 for allowing and blocking communication between the first passage 25 and the low pressure passage 58, and the second open-close valve 52 for allowing and blocking communication between the second passage 27 and the low pressure passage 58. For this reason, communication and cutoff between the first passage 25 and the low pressure passage 58 and communication and cutoff between the second passage 27 and the low pressure passage 58 can be controlled independently of each other. When the first open-close valve 51 blocks off the first passage 25 from the low pressure chamber 57, no fuel leaks between the first passage 25 and the low pressure chamber 57. When the second open-close valve 52 blocks off the second passage 27 and the low pressure chamber 57, no fuel leaks between the second passage 27 and the low pressure chamber 57. As a result, in a state where the fuel is not injected, the fuel injection valve 20 can reduce the fuel leakage from the high pressure side to the low pressure side of the fuel passages to zero, and thus reduce the energy for supplying the fuel to the common rail 11.

While the first open-close valve 51 and the second open-close valve 52 are closed, by keeping the first open-close valve 51 closed and opening the second open-close valve 52, communication between the high pressure chamber 33 and the injection hole 34 is maintained in a blocked state by the needle valve 31 while the second high pressure passage 14 and the first control chamber 46 are enabled to communicate with each other by the follower valve 41. Therefore, while fuel injection is not performed by the fuel injection valve 20, the fuel inside the second high pressure passage 14 can be discharged through the first control chamber 46, the second passage 27, and the low pressure passage 58. As a result, the second open-close valve 52 corresponds to a pressure reducing valve capable of reducing the fuel pressure in the second high pressure passage 14, i.e., reducing the fuel pressure in the common rail 11 which supplies fuel to the second high pressure passage 14.

The second high pressure passage 14 includes the third throttle 14*a* that restricts fuel flow rate. In a state where the first open-close valve 51 is closed and the second open-close valve 52 is open, the flow rate of the fuel through the third throttle 14*a* is set to be larger than the flow rate of the fuel through the second throttle 27*a*. According to such a configuration, the flow rate of the fuel flowing from the second high pressure passage 14 into the first control chamber 46 via the third throttle 14*a* is greater than the flow rate of the fuel flowing out of the first control chamber 46 via the second throttle 27*a*. For this reason, even when the second passage 27 and the first control chamber 46 are in communication with each other via the follower valve 41, the fuel pressure inside the first control chamber 46 does not decrease, and communication between the high pressure chamber 33 and the injection hole 34 is maintained in a blocked state by the needle valve 31.

When the first open-close valve 51 is closed, the first control chamber 46 and the intermediate chamber 26 are in communication with each other without passing through the third passage 42 due to the follower valve 41. Further, when the first control chamber 46 and the intermediate chamber 26 are in communication each other without passing through the third passage 42 due to the follower valve 41, the second high pressure passage 14 and the first control chamber 46 are in communication with each other due to the follower valve 41. As a result, the fuel pressure inside the first control chamber 46 increases, and the operation can be shifted to the operation of blocking off communication between the high pressure chamber 33 and the injection hole 34 by the needle valve 31.

When stopping fuel injection, it is possible to switch between a state in which the first open-close valve 51 and the second open-close valve 52 are closed and a state in which the first open-close valve 51 is closed while the second open-close valve 52 is open. According to such a configuration, when stopping the fuel injection, the speed at which the fuel pressure inside the first control chamber 46 increases can be changed, and the speed at which the needle valve 31 descends, and consequently, the gradient of the change in fuel injection rate can be changed. When stopping fuel injection, while the first open-close valve 51 and the second open-close valve 52 are closed, the leakage of fuel from the first passage 25 to the low pressure chamber 57 is zero, and the leakage of fuel from the second passage 27 to the low pressure chamber 57 is zero. Therefore, the fuel flowing from the second high pressure passage 14 into the first control chamber 46 and the second control chamber 36 can efficiently increase the fuel pressure inside the second control chamber 36.

While the needle valve 31 is moving in the direction of blocking communication between the high pressure chamber 33 and the injection hole 34, it is possible to switch between a state in which the first open-close valve 51 and the second open-close valve 52 are closed and a state in which the first open-close valve 51 is closed while the second open-close valve 52 is open. According to such a configuration, while the needle valve 31 is descending, the speed at which the needle valve 31 descends, and thus the gradient of the fuel injection rate, can be flexibly changed.

When starting fuel injection, it is possible to switch between a state in which the first passage 25 is in communication with the low pressure passage 58 and the second passage 27 is in communication with the low pressure passage 58, and a state in which the first passage 25 is in communication with the low pressure passage 58 while the second passage 27 is blocked off from the low pressure passage 58. According to such a configuration, when starting fuel injection, the speed at which the fuel pressure inside the first control chamber 46 decreases can be changed, and the speed at which the needle valve 31 rises, and consequently, the gradient of the change in fuel injection rate can be changed. At this time, in the above two states, the amount of fuel flowing from the high pressure passages 13 and 14 into the first control chamber 46 and the second control chamber 36 is zero. Therefore, even when the flow rate of fuel from the first passage 25 and the second passage 27 to the low pressure chamber 57 is small, the fuel pressure inside the control chambers 46 and 36 can be reduced at a required speed, and the needle valve 31 can be lifted with a required responsivity.

While the needle valve 31 is moving in a direction of allowing communication between the high pressure chamber 33 and the injection hole 34, it is possible to switch between a state in which the first passage 25 is in communication with the low pressure passage 58 and the second passage 27 is in communication with the low pressure passage 58, and a state in which the first passage 25 is in communication with the low pressure passage 58 while the second passage 27 is blocked off from the low pressure passage 58. According to such a configuration, while the needle valve 31 is being lifted, the speed at which the needle valve 31 lifts, and thus the gradient of the fuel injection rate, can be flexibly changed.

In the main body of the fuel injection valve 20, the first control chamber 46, in which the follower valve 41 is disposed, and the second control chamber 36, into which the needle valve 31 is exposed, are formed. In the main body, the connection passage 47, which is a passage connecting the first control chamber 46 to the second control chamber 36, is formed. The connection passage 47 includes the fourth throttle 47*a* for restricting fuel flow rate. According to such a configuration, the flow rate of the fuel flowing out of the second control chamber 36 can be limited by the fourth throttle 47*a* of the connection passage 47, and as such, the speed at which the fuel pressure inside the second control chamber 36 decreases can be appropriately set. Further, the transmission of pulsations of fuel pressure between the first control chamber 46 and the second control chamber 36 can be reduced. Therefore, it is possible to prevent pulsations in the fuel pressure from adversely affecting the behavior of the follower valve 41 and the needle valve 31.

The flow rate of the fuel flowing into the first control chamber 46 via the connection passage 47 is larger than the flow rate of the fuel flowing out of the first control chamber 46 via the third passage 42 and the second passage 27. For this reason, it is possible to prevent the fuel pressure inside the first control chamber 46 from excessively decreasing, and to avoid a decrease in the pressure difference in the fuel before and after the first throttle 42*a*. Therefore, the follower valve 41 can be maintained in a state in which the follower valve 41 is attracted to the intermediate chamber 26 due to the difference in fuel pressure between the fuel before and after the first throttle 42*a*.

Second Embodiment

A second embodiment will be described with respect to differences from the first embodiment. The same structural parts as those of the first embodiment are denoted by the same reference numerals thereby to simplify the description.

Figure 29:
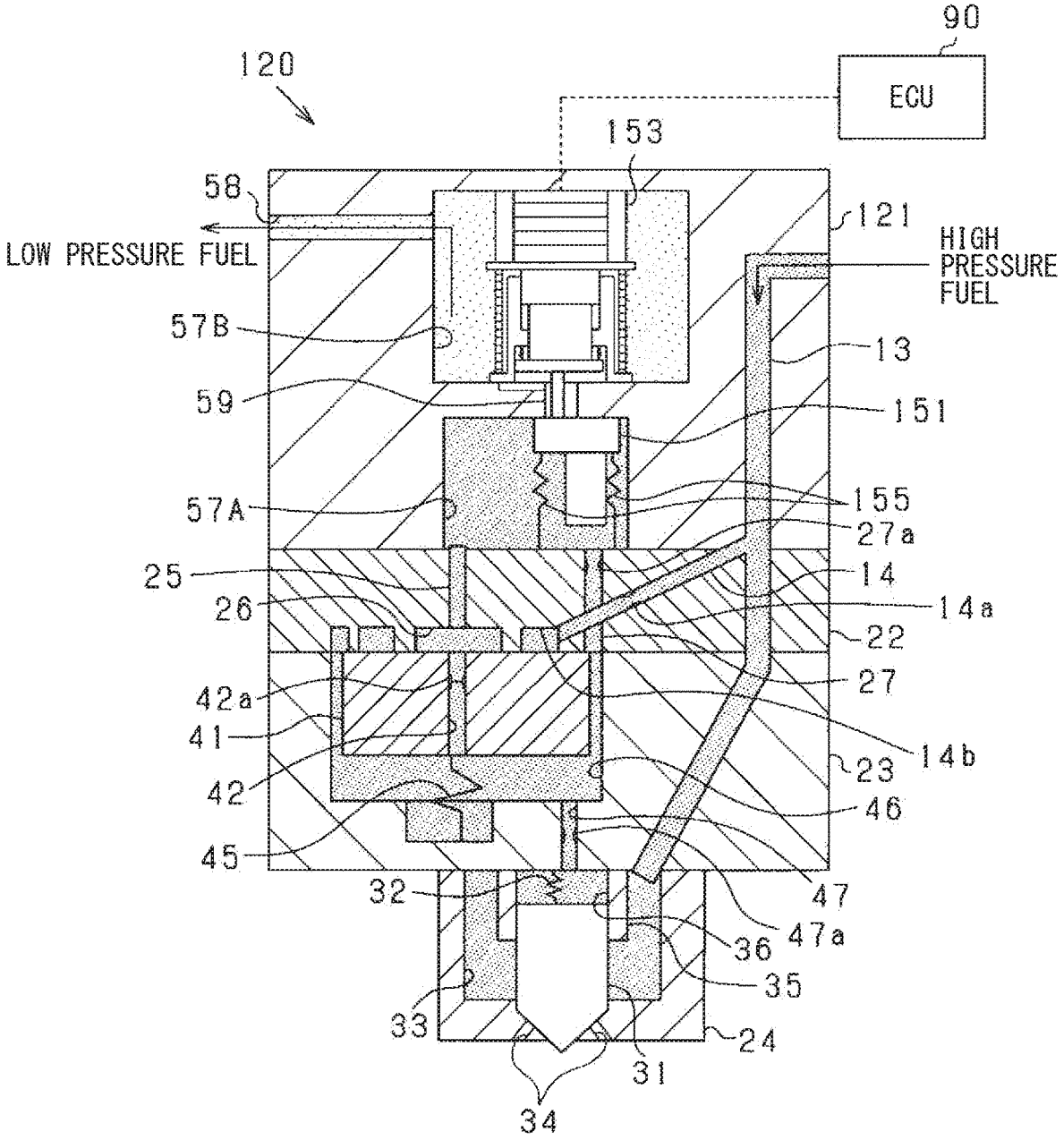
FIG. 29 is a schematic view showing a fuel injection system according to a second embodiment.

As shown in FIG. 29, a first low pressure chamber 57A, a connection passage 59, a second low pressure chamber 57B, and a low pressure passage 58 are formed in the first member 121. The surface of the first low pressure chamber 57A facing the second member 22 has an opening. The periphery of the opening is sealed between the first member 21 and the second member 22. The first low pressure chamber 57A and the second low pressure chamber 57B are connected to each other by the connection passage 59. The low pressure passage 58 is connected to the second low pressure chamber 57B.

The fuel injection valve 120 of the present embodiment includes only one open-close valve 151 instead of the first open-close valve 51 and the second open-close valve 52 of the first embodiment. The open-close valve 151 is biased by a spring 155 in a direction of approaching the second low pressure chamber 57B. An actuator 153 that continuously controls the lift amount of the open-close valve 151 is disposed inside the second low pressure chamber 57B. The actuator 153 includes an expansion/contraction mechanism such as a piezo element (piezoelectric element). When the actuator 153 is not energized, communication between the first low pressure chamber 57A (and in turn the first passage 25 and the second passage 27) and the connection passage 59 (and in turn the low pressure passage 58) is blocked off by the open-close valve 151. The open-close valve 151 does not have a portion that slides in the connection passage 59 (the first member 121), and instead opens and closes the open end of the connection passage 59. When the open-close valve 151 block communication between the first low pressure chamber 57A and the connection passage 59, fuel does not leak between the first low pressure chamber 57A and the connection passage 59. That is, the open-close valve 151 has a leakless structure. The operation state of the actuator 153 is controlled by the ECU 90 (corresponding to a "drive unit").

Figure 30:
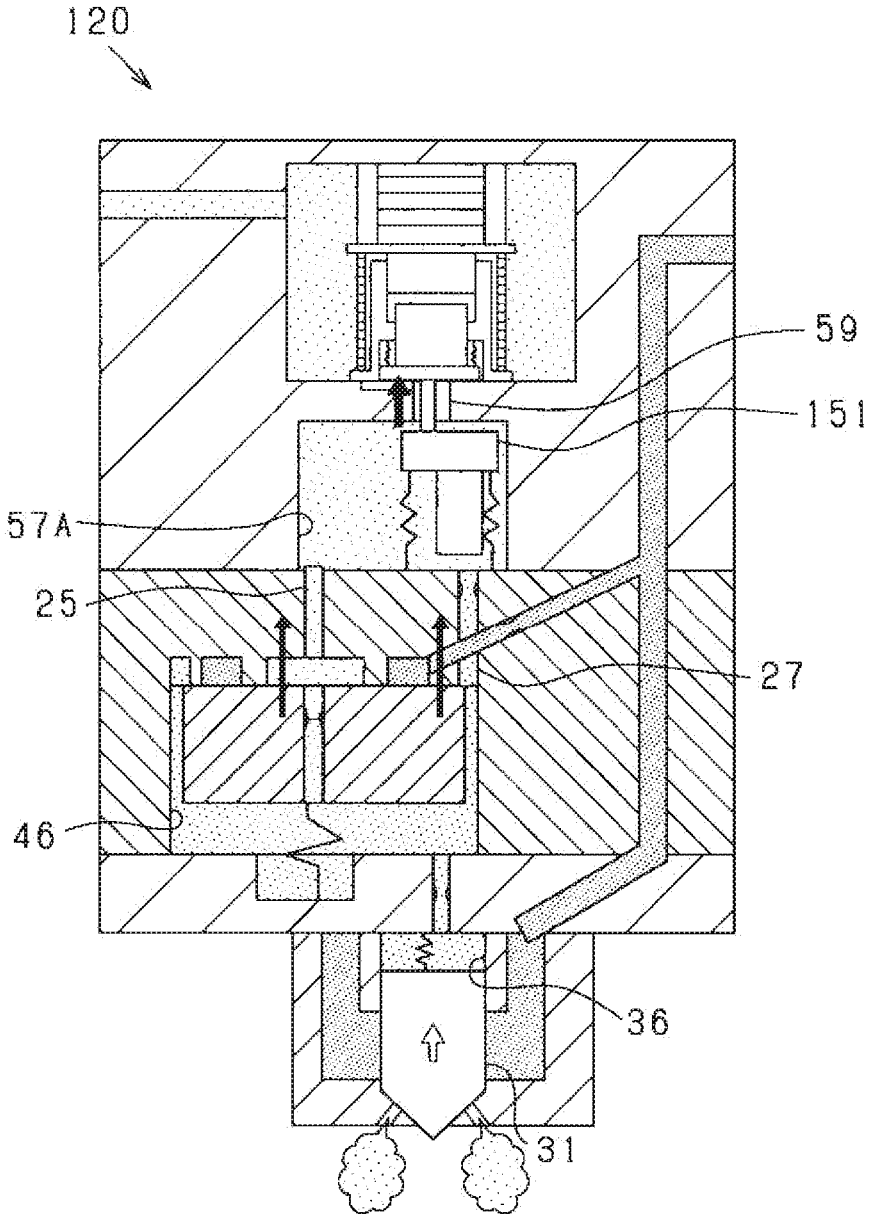
FIG. 30 is a schematic view showing a state of an open-close valve at the time of high speed rise.

FIG. 30 is a schematic view showing a state of the open-close valve 151 at the time of high speed rise. Due to the open-close valve 151, the first low pressure chamber 57A is in communication with the second passage 27, and the first low pressure chamber 57A is in communication with the connection passage 59. Since the fuel inside the first control chamber 46 is discharged through the first passage 25 and the second passage 27, the fuel pressure inside the control chambers 46 and 36 decreases at high speed. That is, since the volume of the second control chamber 36 decreases at a high speed, the needle valve 31 is lifted at a high speed, and the injection rate rises at a high speed. At this time, the amount of fuel flowing from the high pressure passages 13 and 14 into the first control chamber 46 and the second control chamber 36 is zero. Therefore, even when the flow rate of fuel from the first passage 25 and the second passage 27 to the first low pressure chamber 57A is small, the fuel pressure inside the control chambers 46 and 36 can be reduced at a high speed, and the needle valve 31 can be lifted with high responsivity.

Figure 31:
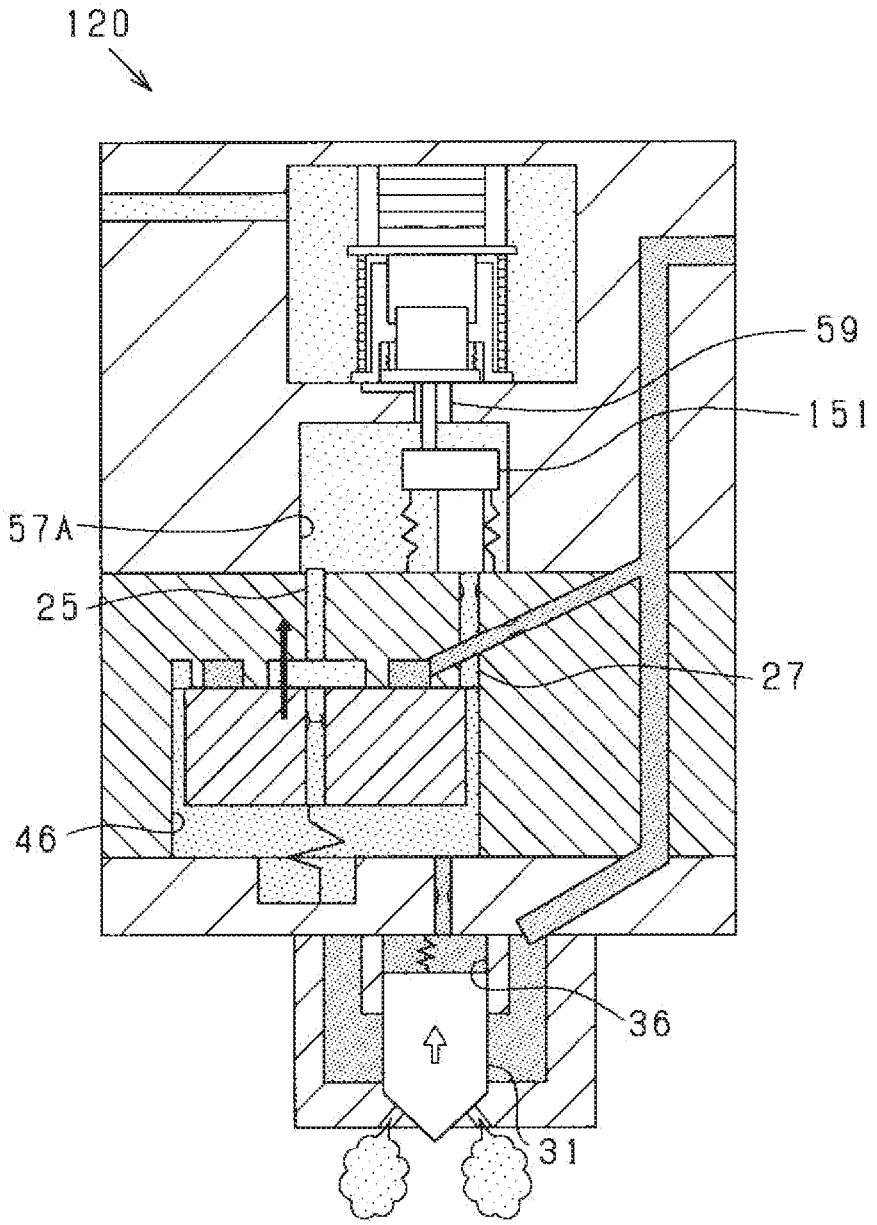
FIG. 31 is a schematic view showing a state of an open-close valve at the time of low speed rise.

FIG. 31 is a schematic view showing a state of the open-close valve 151 at the time of low speed rise. Due to the open-close valve 151, communication between the first low pressure chamber 57A and the second passage 27 is blocked, and the first low pressure chamber 57A is in communication with the connection passage 59. Since the fuel inside the first control chamber 46 is discharged through the first passage 25 but not through the second passage 27, the fuel pressure inside the control chambers 46 and 36 decreases at a low speed. That is, since the volume of the second control chamber 36 decreases at a low speed, the needle valve 31 is lifted at a low speed, and the injection rate rises at a low speed. At this time, the amount of fuel flowing from the high pressure passages 13 and 14 into the first control chamber 46 and the second control chamber 36 is zero. Therefore, even when the flow rate of fuel from the first passage 25 to the first low pressure chamber 57A is small, the fuel pressure inside the control chambers 46 and 36 can be reduced at a required speed, and the needle valve 31 can be lifted with a required responsivity.

Further, by switching between the state shown in FIG. 30 and the state shown in FIG. 31 while the needle valve 31 is being lifted, the speed at which the needle valve 31 is lifted, and thus the gradient of the fuel injection rate, can be flexibly changed. The ECU 90 may control the open/closed state of the open-close valve 151 and therefore the gradient of the fuel injection rate by the fuel injection valve 120 based on the operating state of the engine in which the fuel injection valve 120 is mounted and the fuel pressure in the common rail 11. Further, while the needle valve 31 is rising, the ECU 90 can also switch the open/closed state of the open-close valve 151 between the state shown in FIG. 30 and the state shown in FIG. 31 a plurality of times or continuously.

Thereafter, communication between the first low pressure chamber 57A (and in turn the first passage 25 and the second passage 27) and the connection passage 59 (and in turn the low pressure passage 58) is blocked by the open-close valve 151, so that the needle valve 31 shifts to a valve closing operation. At this time, leakage of fuel from the first low pressure chamber 57A to the connection passage 59 is zero. Therefore, the fuel flowing from the second high pressure passage 14 into the first control chamber 46 and the second control chamber 36 can efficiently increase the fuel pressure inside the second control chamber 36.

It should be noted that the above-described embodiments may be modified as follows. Parts identical to the parts of each of the above embodiment are designated by the same reference signs as the above embodiment to omit redundant description.

The spring 45 for biasing the follower valve 41 in the direction of the second member 22 may be omitted. Even in such a case, by discharging the fuel inside the intermediate chamber 26 through the first passage 25, the fuel pressure inside the intermediate chamber 26 can be reduced, and as a result the follower valve 41 can be attracted to the intermediate chamber 26. Then, in a state where the follower valve 41 is attracted to the intermediate chamber 26, a differential pressure is generated in the fuel before and after the first throttle 42*a* in the follower valve 41, and the follower valve 41 can be maintained in a state of being attracted to the intermediate chamber 26 due to the differential pressure.

Figure 32:
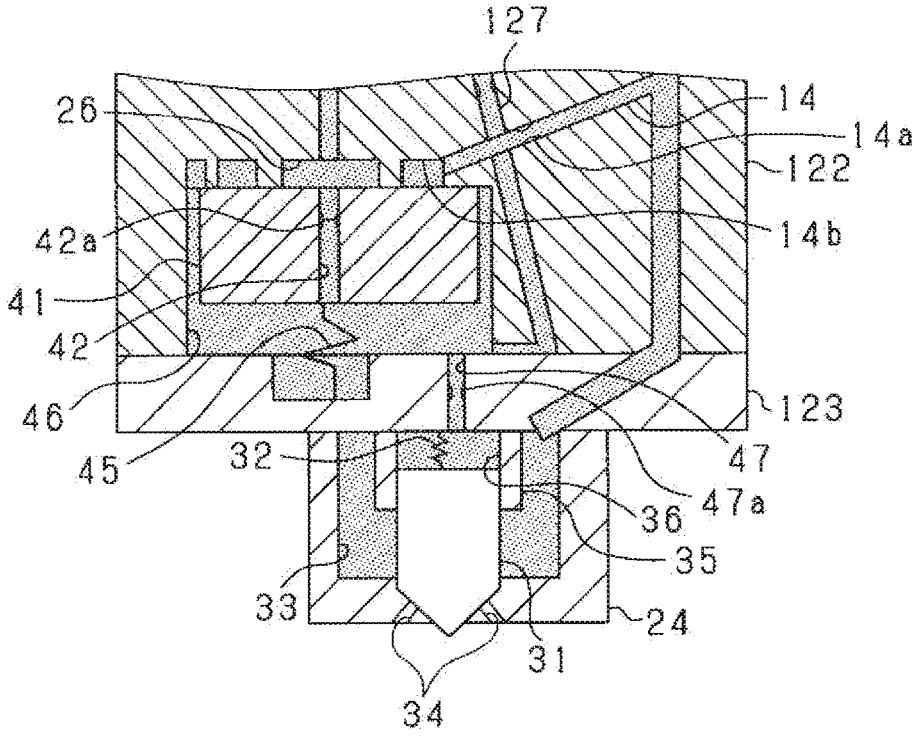
FIG. 32 is a schematic view showing a modified example of a second passage.

As shown in FIG. 32, a configuration in which the first control chamber 46 is formed in the second member 122 and the follower valve 41 is disposed inside the first control chamber 46 may be adopted. Then, inside the second member 122, the second passage 127 and the first control chamber 46 can be connected to each other. With such a configuration, the same operation and effects as in the first embodiment can be obtained.

Figure 33:
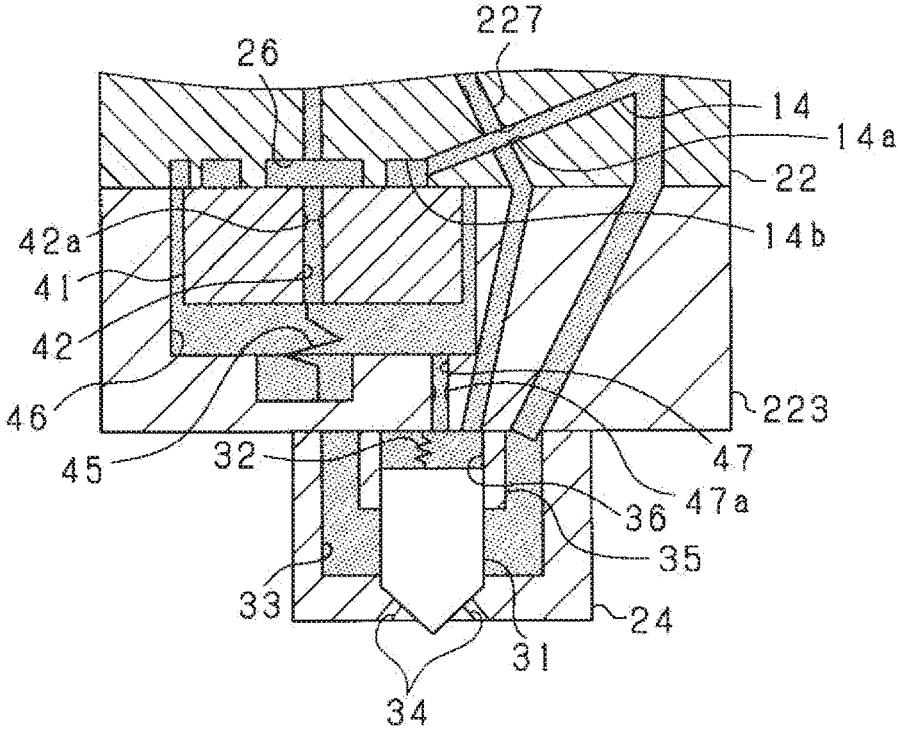
FIG. 33 is a schematic view showing another modified example of a second passage.

As shown in FIG. 33, a configuration in which the second passage 227 is formed across the second member 22 and the third member 223 such that the second passage 227 is connected to the second control chamber 36 may be employed. According to such a configuration, by opening the second open-close valve 52, the fuel pressure inside the second control chamber 36 can be reduced with high responsiveness. In addition, the same operational effects as those of the first embodiment can be obtained.

Figure 34:
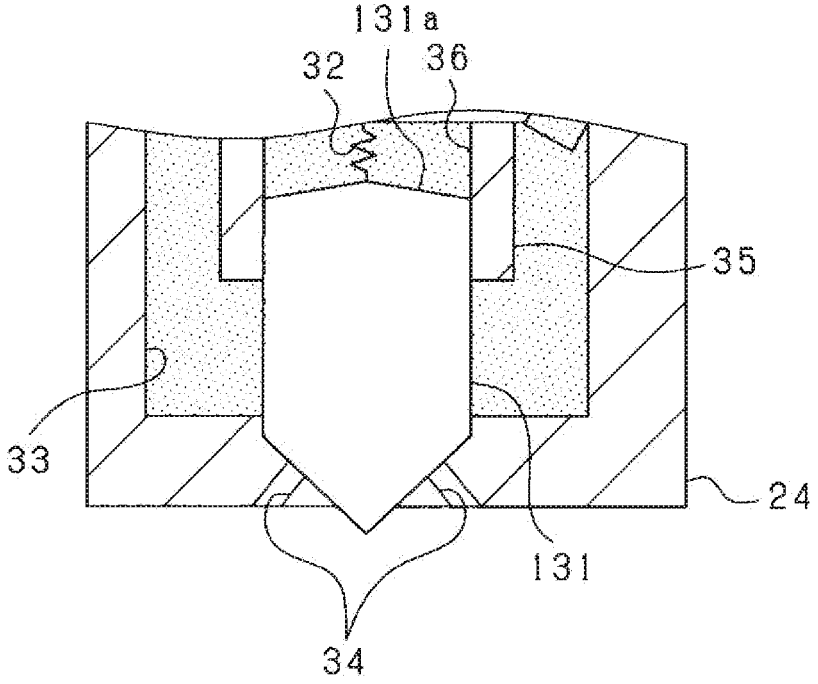
FIG. 34 is a schematic view showing a modified example of a needle valve.
Figure 35:
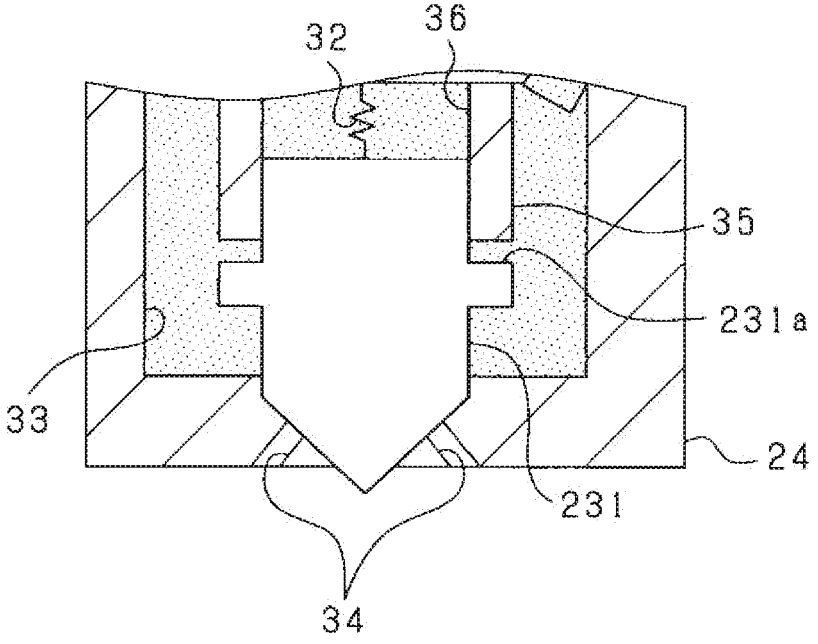
FIG. 35 is a schematic view showing another modified example of a needle valve.

As shown in FIG. 34, a stopper 131*a* which limits (adjusts) the maximum lift amount of the needle valve 131 can be provided in the needle valve 131. Specifically, the stopper 131*a* is provided as a protrusion at the end of the needle valve 131 opposite to the injection hole 34. As the lift amount of the needle valve 131 increases, the stopper 131*a* comes into contact with the third member 23. Further alternatively, as shown in FIG. 35, a stopper 231*a* may be provided as a flange at an intermediate portion of the needle valve 231. As the lift amount of the needle valve 231 increases, the stopper 231*a* contacts the cylinder 35. According to these configurations, the maximum lift amount can be limited while the responsiveness of the needle valves 131 and 231 is increased by reducing the volume of the second control chamber 36.

Figure 36:
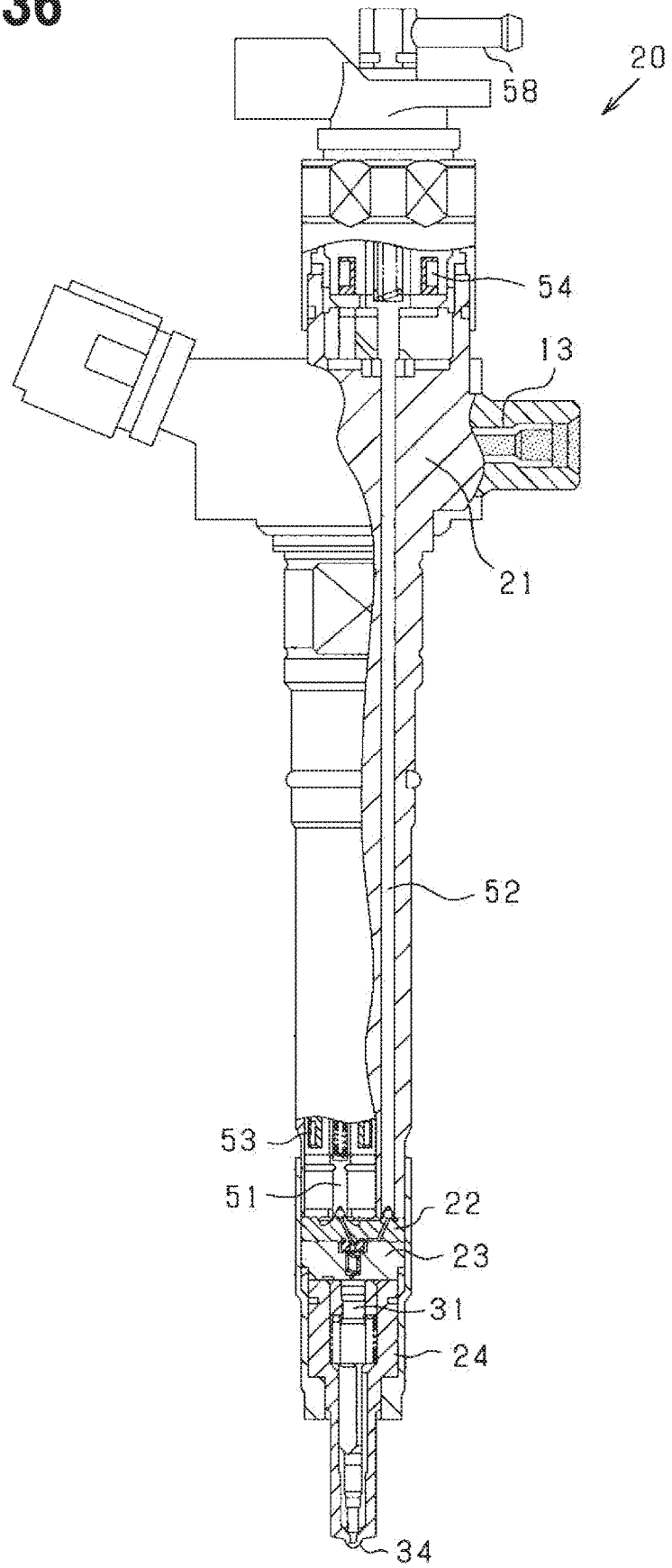
FIG. 36 is a partial cross-sectional view showing a modification of the first embodiment.
Figure 37:
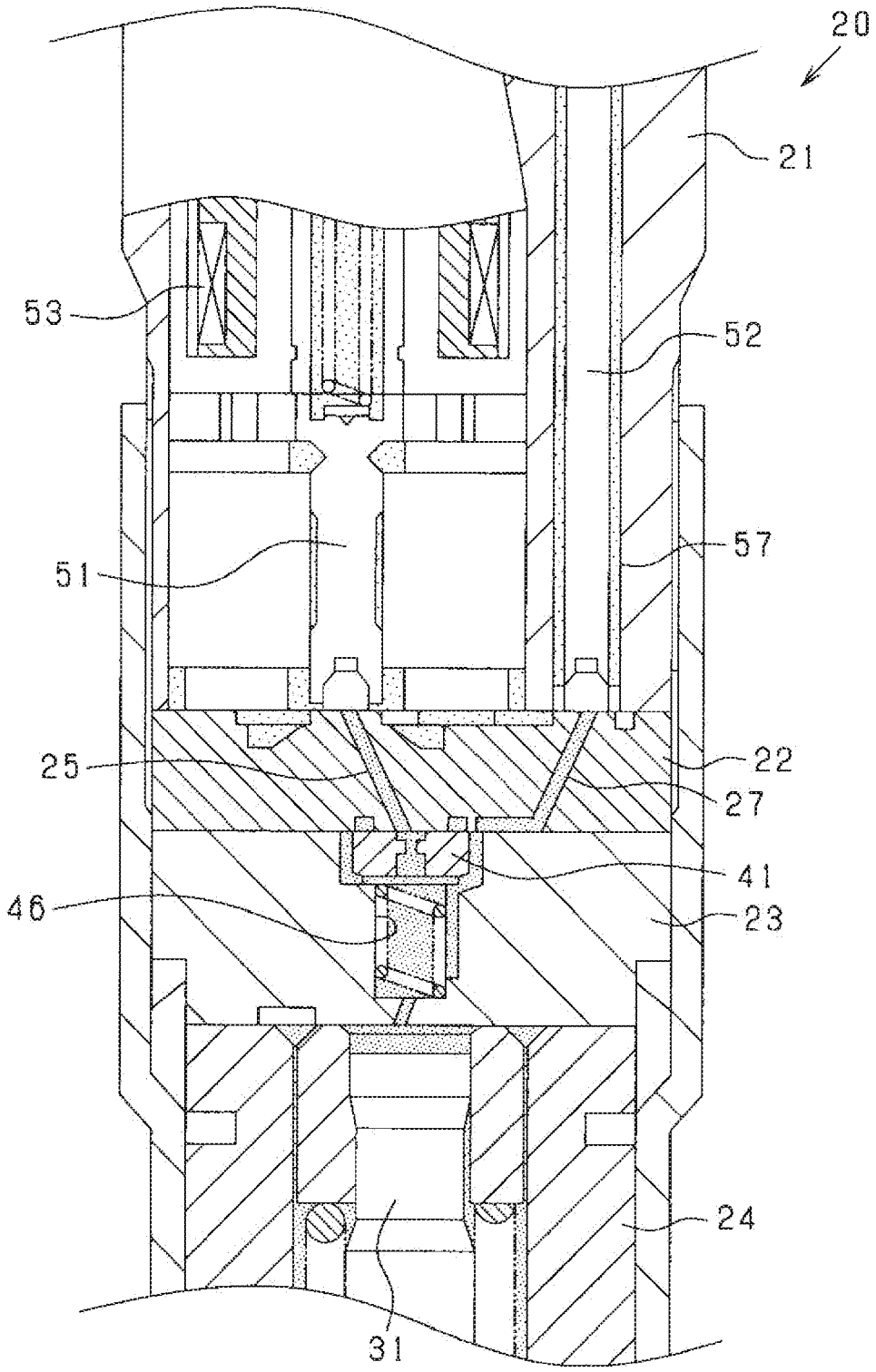
FIG. 37 is an enlarged cross-sectional view showing a part of FIG. 36.

FIG. 36 is a partial cross sectional view showing a modification of the first embodiment, and FIG. 37 is a cross sectional view showing a part of FIG. 36 in an enlarged manner. In this modified example, the position of the first solenoid 53 and the position of the second solenoid 54 are different from each other in the longitudinal direction (axial direction) of the fuel injection valve 20 (needle valve 31). Specifically, the distance from the needle valve 31 to the first solenoid 53 is shorter than the distance from the needle valve 31 to the second solenoid 54. Therefore, compared to a configuration in which the first solenoid 53 and the second solenoid 54 are arranged side by side, the thickness of the fuel injection valve 20 can be reduced (i.e., the diameter of the fuel injection valve 20 can be reduced).

In the longitudinal direction of the fuel injection valve 20, the length of the first open-close valve 51 is shorter than the length of the second open-close valve 52. As shown in FIG. 37, in the first member 21, the low pressure chamber 57 is formed to extend in the longitudinal direction of the second open-close valve 52 (i.e., the longitudinal direction of the fuel injection valve 20) around the outer periphery of the second open-close valve 52. That is, the space in which the second open-close valve 52 is disposed inside the first member 21 can be used as the low pressure chamber 57.

The second solenoid 54 is provided at an end of the main body (first to fourth members 21 to 24) of the fuel injection valve 20 opposite to the injection hole 34. The second solenoid 54 is larger than the first solenoid 53. Therefore, the driving force of the second open-close valve 52 by the second solenoid 54 can be set to be larger than the driving force of the first open-close valve 51 by the first solenoid 53. With the above configuration, the same operation and effects as those of the first embodiment can be obtained.

Although the present disclosure has been described in accordance with the examples, it is understood that the present disclosure is not limited to such examples or structures. The present disclosure encompasses various modifications and variations within the scope of equivalents. In addition, while the various elements are shown in various combinations and configurations, which are exemplary, other combinations and configurations, including more, less or only a single element, are also within the spirit and scope of the present disclosure.

The invention claimed is:

1. A fuel injection valve capable of controlling a gradient of a fuel injection rate, comprising:

a main body including a high pressure chamber supplied with high pressure fuel, an injection hole configured to inject the fuel from the high pressure chamber, a high pressure passage supplied with the high pressure fuel, a control chamber connected to the high pressure passage, a low pressure passage that discharges low pressure fuel, a first passage connected to the low pressure passage, an intermediate chamber that connects the control chamber to the first passage, and a second passage that connects the control chamber to the low pressure passage;

a needle valve configured to, based on a fuel pressure in the control chamber, allow or block communication between the high pressure chamber and the injection hole;

a follower valve provided inside the control chamber, a lift amount of the follower valve being controlled based on a fuel pressure inside the intermediate chamber; and an open-close valve configured to allow or block communication between the first passage and the low pressure passage, and allow or block communication between the second passage and the low pressure passage;

wherein the follower valve is provided with a third passage that extends through the follower valve, a first throttle that restricts fuel flow rate being provided in the third passage, the follower valve is configured to block communication between the high pressure passage and the control chamber when the control chamber is in communication with the intermediate chamber through the third passage, and allow communication between the high pressure passage and the control chamber when the control chamber is in communication with the intermediate chamber without passing through the third passage, and the second passage is in communication with the control chamber without passing through the follow valve, a second throttle that restricts fuel flow rate being provided in the second passage.

2. The fuel injection valve of claim 1, wherein during fuel injection, by blocking communication between the first passage and the low pressure passage with the open-close valve, the control chamber and the intermediate chamber are enabled to be in communication with each other by the follower valve without passing through the third passage.

3. The fuel injection valve of claim 1, wherein the open-close valve includes a first open-close valve configured to allow or block communication between the first passage and the low pressure passage, and a second open-close valve configured to allow or block communication between the second passage and the low pressure passage.

4. The fuel injection valve of claim 3, wherein while the first open-close valve and the second open-close valve are closed, by keeping the first open-close valve closed and opening the second open-close valve, communication between the high pressure chamber and the injection hole is maintained in a blocked state by the needle valve while the second high pressure passage and the control chamber are enabled to communicate with each other by the follower valve.

5. The fuel injection valve of claim 3, wherein a third throttle that restricts fuel flow rate is provided in the high pressure passage, and in a state where the first open-close valve is closed and the second open-close valve is open, the fuel flow rate through the third throttle is set to be larger than the fuel flow rate through the second throttle.

6. The fuel injection valve of claim 3, wherein during fuel injection, by closing the first open-close valve, the control chamber and the intermediate chamber are enabled to be in communication with each other by the follower valve without passing through the third passage.

7. The fuel injection valve of claim 3, wherein when stopping fuel injection, it is possible to switch between a state in which the first open-close valve and the second open-close valve are closed and a state in which the first open-close valve is closed while the second open-close valve is open.

8. The fuel injection valve of claim 3, wherein while the needle valve is moving in a direction of blocking communication between the high pressure chamber and the injection hole, it is possible to switch between a state in which the first open-close valve and the second open-close valve are closed and a state in which the first open-close valve is closed while the second open-close valve is open.

9. The fuel injection valve of claim 3, wherein when starting fuel injection, it is possible to switch between a state in which the first passage is in communication with the low pressure passage and the second passage is in communication with the low pressure passage, and a state in which the first passage is in communication with the low pressure passage while the second passage is blocked off from the low pressure passage.

10. The fuel injection valve of claim 3, wherein while the needle valve is moving in a direction of allowing direction between the high pressure chamber and the injection hole, it is possible to switch between a state in which the first passage is in communication with the low pressure passage and the second passage is in communication with the low pressure passage, and a state in which the first passage is in communication with the low pressure passage while the second passage is blocked off from the low pressure passage.

11. The fuel injection valve of claim 3, wherein when the first passage is in communication with the low pressure passage by the first open-close valve, the control chamber and the intermediate chamber are in communication with each other via the third passage through the follower valve by setting the fuel flow rate restriction of the first throttle, an exposed area of the follower valve to the intermediate chamber, and an exposed area of the follower valve to the high pressure passage.

12. The fuel injection valve of claim 1, wherein the control chamber includes a first control chamber in which the follower valve is disposed, and a second control chamber in which the needle valve is exposed, and the main body is provided with a fourth passage that connects the first control chamber to the second control chamber, a fourth throttle that restricts fuel flow rate being provided in the fourth passage.

13. The fuel injection valve of claim 12, wherein in a state in which:

the first open-close valve is open, the second open-close valve is open, communication between the high pressure passage and the first control chamber is blocked by the follower valve, and communication between the high pressure chamber and the injection hole is allowed by the needle valve, the fuel flow rate through the fourth throttle is set to be greater than a combined fuel flow rate through the first throttle and the second throttle.

14. A fuel injection system, comprising:

the fuel injection valve according to claim 1;

a retention container configured to retain high pressure fuel therein and to supply the high pressure fuel to the high pressure chamber and the high pressure passage; and a drive unit configured to drive the open-close valve to allow or block communication between the first passage and the low pressure passage, and allow or block communication between the second passage and the low pressure passage.

* * * * *